US005649554A

United States Patent [19]

Sprinkel et al.

[11] Patent Number: 5,649,554

[45] Date of Patent: Jul. 22, 1997

[54] ELECTRICAL LIGHTER WITH A ROTATABLE TOBACCO SUPPLY

[75] Inventors: F. Murphy Sprinkel, Glen Allen; Amitabh Das, Midlothian; Grier S. Fleischhauer, Midlothian; Everett C. Grollimund, Midlothian; Willie G. Houck, Jr., Richmond; Peter J. Lipowicz; Ulysses Smith, both of Midlothian; James M. Washington, Richmond; Susan E. Wrenn, Chesterfield, all of Va.

[73] Assignee: Philip Morris Incorporated, New York, N.Y.

[21] Appl. No.: 543,536

[22] Filed: Oct. 16, 1995

[51] Int. Cl.[6] ..... A24F 47/00

[52] U.S. Cl. ..... 131/329; 131/194; 128/202.21; 128/203.17; 128/203.27

[58] Field of Search ..... 131/329, 330, 131/170, 175, 185, 187, 194–198; 128/203.27, 202.21, 203.15, 203.17

[56] References Cited

U.S. PATENT DOCUMENTS

| | | |
|---|---|---|
| 1,771,336 | 7/1930 | Wyss et al. . |
| 1,968,509 | 7/1934 | Tiffany . |
| 2,057,353 | 10/1936 | Whittemore, Jr. . |
| 2,104,266 | 1/1938 | McCormick . |
| 2,442,004 | 5/1948 | Hayward-Butt . |
| 2,974,669 | 3/1961 | Ellis . |
| 3,200,819 | 8/1965 | Gilbert . |
| 3,255,760 | 6/1966 | Selke . |
| 3,363,633 | 1/1968 | Weber . |

(List continued on next page.)

FOREIGN PATENT DOCUMENTS

| | | |
|---|---|---|
| 1202378 | 3/1986 | Canada . |
| 87/104459 | 2/1988 | China . |
| 0 295 122 | 12/1988 | European Pat. Off. . |
| 0 358 002 | 3/1990 | European Pat. Off. . |
| 0 358 114 | 3/1990 | European Pat. Off. . |
| 0 430 566 A2 | 6/1991 | European Pat. Off. . |
| 0 438 862 A2 | 7/1991 | European Pat. Off. . |
| 3 640 917 | 8/1988 | Germany . |
| 3 735 704 | 5/1989 | Germany . |
| 61-68061 | 4/1986 | Japan . |
| 2 132 539 | 7/1984 | United Kingdom . |
| 2 148 676 | 5/1985 | United Kingdom . |
| 2 148 079 | 5/1985 | United Kingdom . |
| WO86/02528 | 5/1986 | WIPO . |
| WO95/05094 | 2/1995 | WIPO . |

*Primary Examiner*—Jennifer Bahr

*Attorney, Agent, or Firm*—James T. Moore; James E. Schardt; Charles E.B. Glenn

[57] ABSTRACT

A lighter is provided having a tobacco flavor heating system which includes a rotatable tobacco containing disc or spiral. This disc or spiral is registered in thermal proximity to a heating element and heated to generate tobacco flavors in response to a sensor. The disc and spiral are sized to provide a convenient number of puffs before disposal. Housings are provided for the disc and spiral to store, register and dispose the tobacco product efficiently. An induction heating system can be employed.

68 Claims, 11 Drawing Sheets

U.S. PATENT DOCUMENTS 3,402,723 9/1968 Hu .
3,482,580 12/1969 Hollebaugh .
3,496,336 2/1970 Hingorany et al. .
3,591,753 7/1971 Gartner .
3,608,560 9/1971 Briskin .
3,738,374 6/1973 Bennett .
3,744,496 7/1973 McCarty et al. .
3,804,100 4/1974 Fariello .
3,889,690 6/1975 Guarnieri .
4,016,061 4/1977 Wasa et al. .
4,068,672 1/1978 Guerra .
4,077,784 3/1978 Vayrynen .
4,131,119 12/1978 Blasutti .
4,141,369 2/1979 Burruss .
4,164,230 8/1979 Pearlman .
4,193,411 3/1980 Faris et al. .
4,194,108 3/1980 Nakajima et al. .
4,203,025 5/1980 Nakatani et al. .
4,215,708 8/1980 Bron .
4,219,032 8/1980 Tabatznik et al. .
4,246,913 1/1981 Ogden et al. .
4,256,945 3/1981 Carter et al. .
4,259,564 3/1981 Ohkubo .
4,259,970 4/1981 Green, Jr. .
4,303,083 12/1981 Burruss, Jr. .
4,307,734 12/1981 Blankenship ..... 128/203.15 X
4,319,591 3/1982 Keith et al. .
4,393,884 7/1983 Jacobs .
4,431,903 2/1984 Riccio .
4,436,100 3/1984 Green, Jr. .
4,463,247 7/1984 Lawrence et al. .
4,505,282 3/1985 Cogbill et al. .
4,562,337 12/1985 Lawrence .
4,570,646 2/1986 Herron .
4,580,583 4/1986 Green, Jr. .
4,621,649 11/1986 Osterrath .
4,623,401 11/1986 Derbyshire et al. .
4,629,604 12/1986 Spector .
4,637,407 1/1987 Bonanno et al. .
4,659,912 4/1987 Derbyshire .
4,682,010 7/1987 Drapeau et al. .
4,686,353 8/1987 Spector .
4,692,590 9/1987 Spector .
4,694,824 9/1987 Ruderian .
4,735,217 4/1988 Gerth et al. .
4,771,796 9/1988 Myer .
4,776,353 10/1988 Lilja et al. .
4,837,421 6/1989 Luthy .
4,846,199 7/1989 Rose .
4,848,376 7/1989 Lilja et al. .
4,874,924 10/1989 Yamamoto et al. .
4,877,989 10/1989 Drews et al. .
4,922,901 5/1990 Brooks et al. .
4,945,931 8/1990 Gori .
4,947,874 8/1990 Brooks et al. .
4,947,875 8/1990 Brooks et al. .
4,966,171 10/1990 Seranno et al. .
4,981,522 1/1991 Nichols et al. .
4,991,606 2/1991 Seranno et al. .
4,998,541 3/1991 Perfetti et al. .
5,016,656 5/1991 McMurtrie .
5,035,237 7/1991 Newell et al. ..... 128/203.15 X
5,040,552 8/1991 Schleich et al. .
5,042,510 8/1991 Curtiss et al. .
5,060,671 10/1991 Counts et al. .
5,076,296 12/1991 Nystrom et al. .
5,093,894 3/1992 Deevi .
5,095,921 3/1992 Losee et al. .
5,144,962 9/1992 Counts et al. .
5,159,940 11/1992 Hayward et al. .
5,179,966 1/1993 Losee et al. .
5,188,130 2/1993 Hajaligol et al. .
5,224,498 7/1993 Deevi et al. .
5,235,157 8/1993 Blackburn .
5,249,586 10/1993 Morgan et al. .
5,269,327 12/1993 Counts et al. .
5,274,214 12/1993 Blackburn .
5,285,050 2/1994 Blackburn .
5,331,953 7/1994 Andersson et al. ..... 128/203.15 X
5,388,594 2/1995 Counts et al. .
5,479,948 1/1996 Counts et al. .

ELECTRICAL LIGHTER WITH A ROTATABLE TOBACCO SUPPLY

RELATED PATENTS AND APPLICATIONS

The present application relates to commonly assigned U.S. patent application Ser. No. 08/105,346, filed Aug. 10, 1993; Ser. No. 08/380,718, filed Jan. 30, 1995, which in turn is a continuation-in-part of patent application 08/118,665, filed Sep. 10, 1993, now U.S. Pat. No. 5,388,594 issued Feb. 14, 1995 and relates to commonly assigned patent application Ser. No. 07/943,504, filed Sep. 11, 1992, which in turn is a continuation-in-part of patent application Ser. No. 07/666,926 filed Mar. 11, 1991, now abandoned in favor of filewrapper continuation application Ser. No. 08/012,799, filed Feb. 2, 1993, which is now U.S. Pat. No. 5,249,586 issued Oct. 5, 1993; Ser. No. 08/225,120, filed Apr. 8, 1994; Ser. No. 08/224,848, filed Apr. 8, 1994; and Ser. No. 08/314,463, filed Sep. 28, 1994, all of which are hereby incorporated by reference in their entireties.

BACKGROUND OF THE INVENTION

1. Technical Field of the Invention

The present invention relates generally to electrical lighters and more specifically to an electrical smoking lighter having a rotatable substrate in the shape of a disc or spiral bearing tobacco and further comprising suitable heaters and control logic.

2. Discussion of the Related Art

Previously known conventional lit cigarettes deliver flavor and aroma to the user as a result of combustion of tobacco. A mass of combustible material, primarily tobacco, is oxidized as the result of applied heat with typical combustion temperatures in a conventional lit cigarette being more than 800° C. during puffing. Heat is drawn through an adjacent mass of tobacco by drawing on the mouth end. During this heating, inefficient oxidation of the combustible material takes place and yields various distillation and pyrolysis products. As these products are drawn through the body of the lit cigarette toward the mouth of the smoker, they cool and condense to form an aerosol or vapor that gives the consumer the flavor and aroma associated with smoking.

Conventional lit cigarettes have various perceived drawbacks associated with them. Among them is the production of sidestream smoke during smoldering between puffs, which may be objectionable to some non-smokers. Also, once lit, they must be fully consumed or be discarded. Relighting a conventional cigarette is possible but is usually an unattractive prospect for subjective reasons (flavor, taste, odor) to a discerning smoker.

A prior alternative to the more conventional lit cigarettes includes those in which the combustible material itself does not directly provide the flavorants to the aerosol inhaled by the smoker. In these lit cigarettes, a combustible heating element, typically carbonaceous in nature, is combusted to heat air as it is drawn over the heating element and through a zone that contains heat-activated elements that release a flavored aerosol. While this type of lit cigarette produces less sidestream smoke, it still generates products of combustion, and once lit it is not adapted to be snuffed for future use in the conventional sense.

In both the more conventional lit cigarettes and lit carbon element cigarettes described above combustion takes place during their use. This process naturally gives rise to many by-products as the combusted material breaks down and interacts with the surrounding atmosphere.

Several proposals have been advanced which significantly reduce undesired sidestream smoke while permitting the smoker to suspend smoking of the cigarette for a desired period and then to resume smoking. Commonly assigned U.S. Pat. Nos. 5,093,894; 5,225,498; 5,060,671 and 5,095,921 disclose various electrical resistive heating elements and flavor generating systems which significantly reduce sidestream smoke while permitting the smoker to selectively suspend and reinitiate smoking. Alternatively, semiconductor heaters, such as those described in copending, commonly assigned U.S. patent application Ser. No. 07/943,505, filed Sep. 11, 1992 and hereby incorporated by reference in its entirety, can be used. Additional heater configurations are also disclosed in application Ser. No. 07/943,505, as well as in copending, commonly assigned U.S. patent application Ser. No. 07/943,504, filed Sep. 11, 1992 and hereby incorporated by reference in its entirety.

These replaceable heater/flavor units contain a limited number of individual charges of tobacco, and thus provide a limited number of portions or puffs of tobacco flavors to the smoker. For example, a heater/flavor unit of the type described above might provide eight or ten puffs as provided by a more conventional lit cigarette. The smoker would be required to continually change heater/flavor units throughout a day of using the electrical lighter. Each time the heater/flavor unit is changed, additional wearing of the contacts on the permanent portion of the lighter occurs. Also, each spent heater/flavor unit increases the volume of material to be disposed.

U.S. Pat. No. 5,388,594, issued Feb. 14, 1995, U.S. patent applications Ser. No. 08/380,718, filed Jan. 30, 1995; Ser. No. 08/425,166, filed Apr. 20, 1995, entitled "Cigarette for Electrical Smoking System" (Attorney Docket No. PM 1759A); Ser. No. 08/425,837, filed Apr. 20, 1995, entitled "Cigarette for Electrical Smoking System" (Attorney Docket No. PM 1759B); and Ser. No. 08/426,165, filed Apr. 20, 1995, (Atty. Docket No. PM 1768) describe novel electrically powered lighters and novel cigarettes adapted to cooperate with the lighter. The preferred embodiment of the lighter of U.S. Pat. No. 5,388,594 includes a plurality of metallic sinusoidal heaters disposed in a configuration that slidingly receives a tobacco rod portion of the cigarette. One of the many advantages is the reusability of the lighter for numerous cigarettes.

In the above noted electrical smoking systems, the cigarette is manually removed from the lighter by the smoker. Relatively tight interfaces between the cigarette and heater blades, e.g., inwardly biased blades, are desired for good thermal transfer to the cigarette, but may require a forceful pulling by the smoker to withdraw the cigarette, potentially damaging the heater assembly, electrical connections, etc. Also, this withdrawal could possibly break the thermally weakened cigarette, thereby complicating, if not frustrating, cigarette removal and potentially leaving cigarette remnants in the lighter which may block insertion of subsequent cigarettes or affect subjective qualities of subsequently smoked cigarettes.

The lighter described in the incorporated application Ser. No. 08/105,346 comprises a tobacco containing web enclosed in a cassette casing for registry with a heating configuration via a web advancing mechanism. This lighter provides a significant number of puffs without the need for replacement and avoids excessive trauma to heater elements. However, it would be desirable to provide a more sound tobacco carrier than a web which may potentially be subject to uneven tensioning and, perhaps, complete failure, especially after heating.

As with any widely used consumer product, it would also be desirable to reduce the amount of disposable components of any electrical lighter. For example, it would be desirable to limit required disposal of a used component to a convenient time, e.g., once per day. Also, it would be desirable to provide a supply of tobacco for an electrical lighter which is easily inserted and removed from the lighter. It would also be desirable to provide a replaceable flavor or heater/flavor unit for such an electrical lighter.

OBJECTS OF THE INVENTION

It is an object of the present invention to provide a lighter in which the tobacco is rotatably advanced into registry with a heater.

It is a further object of the present invention to provide a replaceable tobacco-containing unit or heater/tobacco-containing unit for such a lighter which can provide a relatively large number of tobacco portions to reduce the wear on the permanent portion of the lighter, to reduce the volume of disposable material, and to increase the convenience of the lighter to the smoker.

It is another object of the present invention to provide a tobacco flavor to a smoker when desired without producing a significant amount of smoke between puffs.

It is a further object of the present invention to reduce forces acting on a heater of an electrical lighter before, during and after registration of tobacco therewith.

It is another object of the present invention to reduce forces on the tobacco before, during, and especially after registration with a heater unit of an electrical lighter.

It is a further object of the present invention to protect a supply of tobacco during periods of nonuse in conjunction with an electrical lighter.

Additional objects and advantages of the present invention are apparent from the specification and drawings.

SUMMARY OF THE INVENTION

The foregoing and additional objects are obtained by a tobacco heating lighter according to the present invention. This system comprises a disc- or spiral-shaped substrate carrying or comprising tobacco. In addition, a registering system is provided to register a section of the substrate in thermal proximity to a heater. In the disc-shaped embodiment, the disc may be provided with a housing having a window to permit registry between the enclosed disc and the electrical heater. This window may be wedge shaped to optimize exposure of the disc. The heater may be shaped in accordance with this window to optimize registry and minimize power requirements to the heater. The discs are rotated relative to the heater. Preferably, a section of the disc is heated and then relative rotational movement between the heater and disc is effected to register a successive disc portion with the heater, preferably in a radially sequential order. An induction heating system can be employed.

Alternatively, a spiral structure can be employed which supports or comprises the tobacco. Preferably the spiral structure is circular, though other geometric configurations may be employed. The spiral may comprise a single or multiple turns. If multiple turns are present, the spiral may be comprised of a plurality of discrete single turn spiral elements constructed by radially cutting a plurality of discs.

The spiral defines a central hub which is mated with a drive axle to permit a section of the spiral structure to travel from a supply chamber for storing nonused portions, to thermal registry with the heater, and ultimately to a disposal chamber for storing used sections. This transport is accomplished by rotating the spiral structure in a screw-like manner. The heater is preferably oriented parallel to a screw angle defined by the spiral structure such that a section of the tobacco of the spiral structure is in parallel registry therewith. The spiral can comprise a support track comprising of individual links, each link bearing a tobacco panel.

DETAILED DESCRIPTION OF PREFERRED EMBODIMENTS

The present invention generates tobacco flavors for delivery to a smoker by rotating a supply of tobacco about an imaginary rotational axis so that a section of tobacco is in thermal registry with a heater. The tobacco supply is then discretionarily rotated to move this heated tobacco section out of registry with the heater and to move a new tobacco section into registry therewith.

Figure 1:
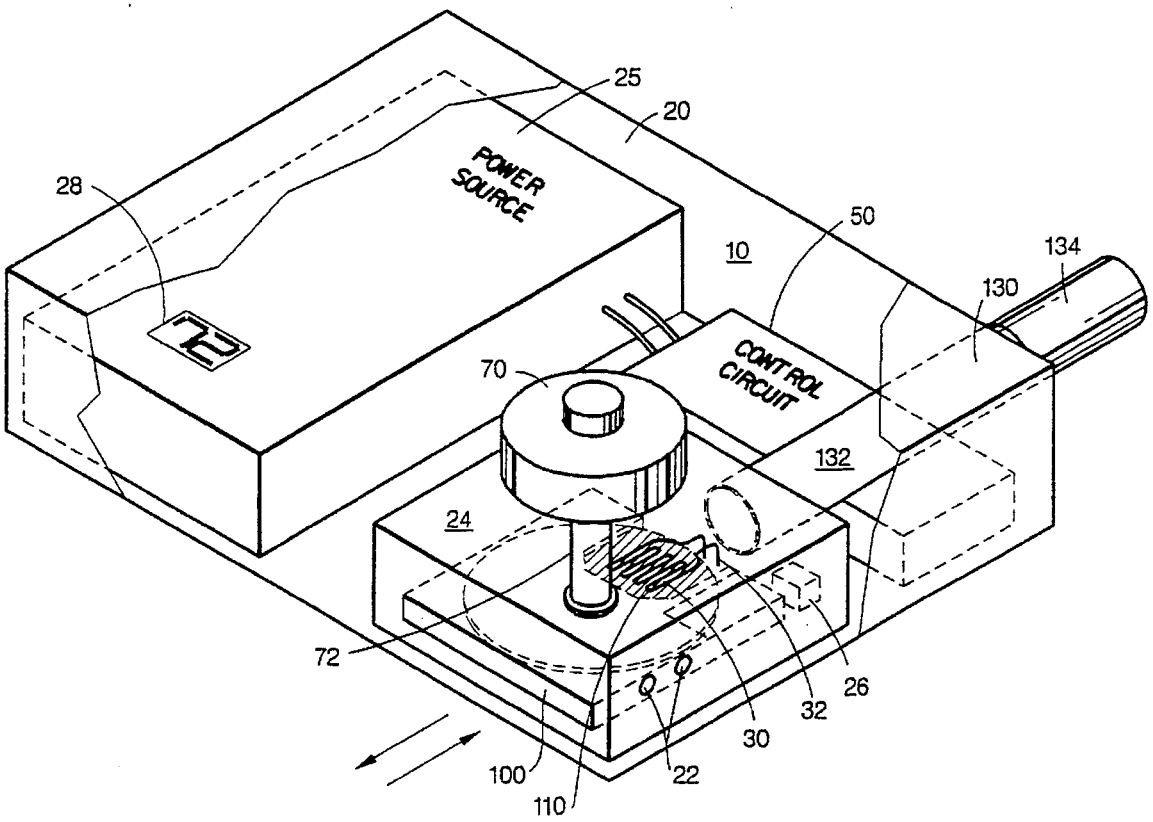
FIG. 1 is an exposed elevational view of a first embodiment of the present invention comprising a tobacco-bearing disc and associated heater and registry system.

Referring to FIG. 1, a lighter 10 according to a first embodiment of the present invention is shown. A relatively permanent housing portion 20, shown broken away for clarity, encloses and contains heating system 30 for heating the tobacco to generate tobacco flavors as discussed in the related applications; a control system or circuit 50; and a disc movement system 70. Housing portion 20 is configured to receive, via insertion, a removable and potentially replaceable or disposable portion 100 which comprises a tobacco bearing or containing substrate or supply 110 and a flavor delivery system 130. Any described system can be located in either the permanent or disposable portion depending on the particular system's useful life. For example, the filter 134 and/or the mouthpiece 132 discussed below can be designed to last longer than the particular supply of tobacco. Indeed, intermediate life times between the relatively "permanent" and "disposable" portions may be desirable for these elements.

The elements of lighter 10 will now be described in general terms. Portion 100 is insertable into a receptacle defined within permanent portion or housing 20. Any conventional and suitable insertion mechanism can be employed, e.g., a U-shaped channel (not shown) can be provided within the permanent portion for engagement of the disposable portion. Mouthpiece 132 of the delivery system is preferably registered with the inserted disposable portion 100 to be in fluid communication with a heater registry chamber or section 24 which is sealed except for communication with air entry ports 22 in the housing 20. Mouthpiece 132 is a hollow cylinder and may optionally have a suitable filter 134 removably attached and adapted to be drawn on by the smoker. If employed, filter 134 preferably has the same or longer useful life compared to any tobacco bearing disc or spiral used in order to reduce the number of occurrences of discrete component replacements by the smoker. The tobacco bearing disc or spiral can comprise a number of tobacco portions sufficient to provide a large number of puffs, e.g., more than a conventional cigarette, e.g., enough for a full day or more of smoking. It is possible that the filter 134 may be become saturated or otherwise unusable before all the portions are consumed. Accordingly, the filter may be separately removable so that it can be replaced by the smoker more or less frequently than the tobacco supply.

It may be desirable to wrap filter plug 134 in a suitable tipping paper also having a pleasing cosmetic appearance such as the familiar "cork" tipping paper used on some conventional cigarettes. Mouthpiece 132 can comprise a constricted tube, and can have a diameter between about 0.024 inches (about 0.609 mm) and about 0.032 inches (about 0.813 mm), which provides a pressure drop or resistance-to-drawn (RTD) for the smoker of less than or between about 10 inches (about 254 mm) of water and about 0.4 inches (about 10 mm) of water, and preferably between about 6 inches (about 153 mm) of water and about 4 inches (about 100 mm) of water. Alternatively or additionally, the desired RTD is obtained by sealing disposable portion 100 and sealing the housing 20 except for air entry ports 22. The size of air entry ports 22 are limited to increase RTD, and visa versa. Placing the constricted tube between heater 32 and ports 22 allows the pressure sensing function to be separated from the disposable portion 100.

When the smoker draws on the mouth end, air is drawn from the outside of the lighter via the air ports or openings 22; through the heater registry chamber 24 and specifically past the heater 32 which is in registry with a suitable tobacco containing structure as discussed below to generate desired tobacco flavors to mix with and entrain the tobacco flavors; and through the mouthpiece 132 and filter 134 to the smoker. Also, the lowered pressure between the constricted tube and mouth of the smoker is sensed to trigger the heater 32 starting to heat the tobacco. More specifically, when the smoker draws on the mouthpiece, a puff sensor 26 detects the air flow and causes control circuitry 50 to actuate the heating mechanism 30 for an appropriate predetermined period of time, evolving tobacco flavors from the tobacco containing structure to be carried along with the drawn air flow to the smoker. This heating and pressure sensing is described in greater detail in the incorporated patents and applications.

Other sensor mechanisms can be employed to alert the control circuitry for heating and/or rotation such as a smoker activated push button or an appropriate flow sensor such as an optical flow sensor or a flow sensing device based on hot wire anemometry The puff actuated sensor can be a model 163PCO1D35 silicon sensor, manufactured by the MircoSwitch division of Honeywell, Inc., of Freeport, Ill. or a model SLP004D 0–4 in. $H_2O$ Basic Sensor Element commercially available from SenSym, Inc. of Milpitas, Calif. 95035. Alternatively, the disc can be heated and/or advanced via a smoker actuated switch or trigger to signal the control and drive mechanisms.

Lighter 10 can have suitable indicators 28, e.g., on the outer surface of permanent portion 20, to inform the smoker of the state of the heater, of any lockout period that may be provided between puffs, and of the number of portions corresponding to puffs remaining and/or smoked, as described in the above-incorporated patents and applications. In addition or alternatively, indicators 28 can report the status of the power source 25.

"Permanent" portion 20 can be reactivated until the power source 25 is depleted. The power source can be removed and replaced. Alternatively, the power source is rechargeable either in or out of the lighter as is described in the above incorporated patents and applications, in which case portion 20 can be substantially, truly permanent. For example, power sources such as those described in Ser. No. 08/380,718, filed Jan. 30, 1995, which in turn is a continuation-in-part of patent application Ser. No. 08/118,665, filed Sep. 10, 1993, now U.S. Pat. No. 5,388,594 issued Feb. 14, 1995, and in Ser. No. 105,346, which are incorporated in their entireties, can be employed.

The heater 32 of the lighter 10 can be a serpentine-shaped metallic heater, as shown in FIGS. 3A, 3B, 3C, 3D, and 3E, made of any suitable conductor of appropriate electrical resistivity to generate the desired temperature. As shown in FIGS. 3A–3E, the heater 32 is preferably mounted on a PEEK and ceramic substrate, as discussed below. A preferred material for heater 32 is a nickel-chromium-aluminum-iron-yttrium alloy such as an alloy comprising about 75% nickel, about 16% chromium, about 4.5% aluminum, about 3% iron, and traces of yttrium such as that sold by Haynes International, of Kokomo, Ind., under the trademark HASTELLOY® or the trademark HAYNES 214®. Another preferred alloy comprises about 51% nickel, about 24% chromium, about 14% tungsten, about 5% cobalt, about 3% iron, and about 2% molybdenum, such as that sold by Haynes International under the trademark HAYNES 230®. Alternatively, an alloy comprising about 80% nickel and about 20% chromium such as that sold by Driver-Harris Company of Harrison, N.Y., under the trademark NICHROME® may be used. Possible heater materials and/or configurations, energy requirements, material properties, etc. are disclosed in application Ser. No. 07/943,505, as well as in copending, commonly assigned U.S. patent application Ser. No. 07/943,504, filed Sep. 11, 1992 and hereby incorporated by reference in its entirety.

Although some of these heater materials may be too brittle for use in a blade heater arrangement of the type described in the related applications and patents, a single or multiple heater of the type contemplated herein can be supported sufficiently substantially to reduce such a risk. As best shown in FIGS. 2, 3A, 3B, and 5, wire leads 33 are electrically connected to power source 25, which in turn is connected to control circuit 50, and are attached, preferably by laser welding, to respective terminal ends 34*a* and 34*b* of the heater 32. More specifically, ends 34*a* and 34*b* are affixed in an insulating substrate 36 and are in electrical contact with leads 33 directed into substrate 36. Substrate 36 is preferably a polyetheretherketone (PEEK) polymer such as that sold by Imperial Chemical Industries, of Great Britain. Substrate 36 is in turn affixed to ceramic support 35 in a face-to-face relationship. Ceramic substrate 35 is preferably made from zirconia or alumina. A ceramic clamping block 37 is affixed perpendicularly to ceramic support 35 and is preferably made from the same material as support 35. C-shaped clamping block 37 supports heater 32 at the top and the bottom, and central region 37*a* of clamping block 37 is preferably depressed to define an air space 37*b* to minimize conductive heat loss from the heater to clamping block 37. Preferably, the depressed central region 37*a* of clamping block 37 is coated with a gold layer 38 to reflect heat radiated from the heater 32 back toward the tobacco. Such a heater is further described in the incorporated patent application Ser. No. 08/105,346.

Alternatively, the thin film platinum heater described in related application Ser. No. 08/314/463, filed Sep. 28, 1994, which is incorporated in its entirety, comprising a ceramic substrate having a thin platinum film resistive heater deposited thereon is employed. Preferably, this heater is arranged such that the side of the ceramic substrate opposite the deposited platinum film is facing the tobacco.

More specifically, a lift-off photolithographic technique is employed to apply a thin film of platinum as the resistive heater element. A ceramic, e.g., alumina or zirconia, is spin coated with an appropriate photoresist, e.g. Shipley 400, at, e.g., approximately 4000 rpm for approximately 25 seconds and then dried at, e.g., approximately 90° C. for approximately ten minutes. Next, an appropriate mask of the desired heating element is applied and an exposure to UV is conducted for, e.g., approximately six seconds. The substrate is then baked for, e.g., approximately fifteen minutes at approximately 100° C. Platinum film is then deposited, e.g., by sputtering and the exposed photoresist is washed with a developer, e.g., the photoresist with platinum thereon is then removed in acetone with ultrasonic agitation. Next, the element is rinsed with ethanol and purged with nitrogen. Suitable leads, e.g., copper, are then connected, e.g., eutectically bonded, to the formed heater as described more fully in Ser. No. 08/314,463, which is incorporated in its entirety. Any other appropriate deposition technique may be employed.

The heater 32 may be rectangular or square shaped and may employ the serpentine shape having a constant amplitude described more fully in the incorporated U.S. Pat. No. 5,388,594 and as shown in FIGS. 1 and 3A. If a pie-piece window 116 is employed, preferably the heater 32 comprises a substrate 35 which is also wedge shaped and has a serpentine heating coil 37 having a constantly varying amplitude such that the heating coil 37 closely tracks the edge of the supporting substrate 35, as shown in FIG. 3C. In other words, the serpentine-shaped heating coil has an amplitude which increases radially outward relative to the wedge-shaped substrate and the portion of the disc registered therewith. Alternatively, as shown in FIG. 3D, the serpentine heating coil 37 has an amplitude which increases from an initial point to a maximum and then decreases to an end point, such that the maximum amplitude occurs approximately in line with the apex of the substrate 35 to maximize registration between the heater and the substrate. The supporting substrate 35 may be any geometric shape so long as the serpentine-shaped heater element 37 is sized to register with an unused portion of disc 112 exposed via window 116. The serpentine shaped heater may be formed as described in incorporated U.S. Pat. No. 5,388,594 using an appropriate "footprint" in the desired shape. Alternatively, the various serpentine shapes are formed on a ceramic substrate via the photolithographic technique discussed above.

Figure 3E:
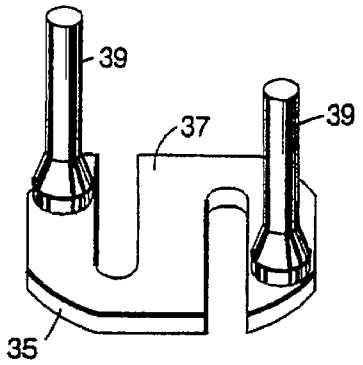
FIG. 3E is an elevational view of an S-shaped, platinum film heater.
Figure 3A:
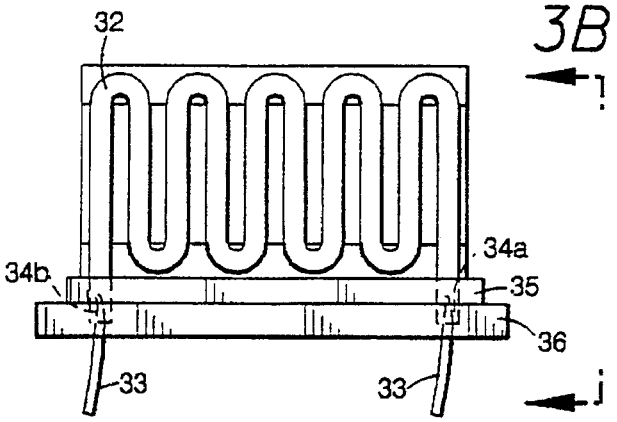
FIG. 3A is a front view of an embodiment of the heater having a serpentine heating element with a constant amplitude.
Figure 3B:
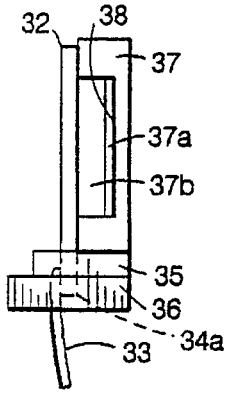
FIG. 3B is a side view of the heater taken along the line 3B of FIG. 3A.
Figure 3C:
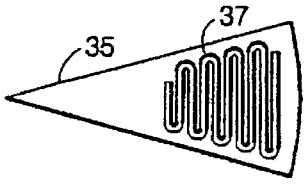
FIG. 3C is a top view of a wedge-shaped heater having a serpentine heating element with a decreasing amplitude.
Figure 3D:
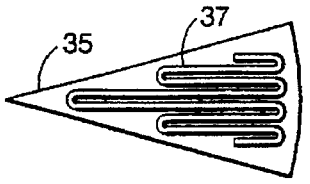
FIG. 3D is a top view of a heater having a serpentine heating element with an amplitude which increases to a maximum and then decreases.

As shown in FIG. 3E, the heater 37 can be substantially S-shaped and is preferably platinum deposited on a ceramic substrate 35 as described above. Copper leads, and preferably copper posts 39 as described in Ser. No. 08/314,463, filed Sep. 28, 1994, are eutectically bonded to the ends of the heater, as discussed above. Preferably, the supporting substrate 35 is also substantially S-shaped to correspond with substantially S-shaped heater 37. This S-shape permits thermally induced deflection of the substantially parallel legs of the S-shaped heater 37 and underlying substrate 35 while maintaining electrical connections and thermal registry with the tobacco. Alternatively, a substantially U-shaped heater 37 and underlying substrate 35 are employed.

Referring again to FIG. 2, an insertable and replaceable or disposable substrate 110 is shown in the form of a single, preferably circular disc 112. Disc 112 comprises tobacco and is preferably formed of reconstituted tobacco. Alternatively, disc 112 can comprise a supporting substrate having the geometric structures described herein and having portions of tobacco located thereon, similar to the tobacco bearing web disclosed in Ser. No. 08/105,346, which is incorporated in its entirety, wherein the supporting substrate is preferably cellulose. A disc of tobacco sheet can be employed. A base disc can be used of a woven or non-woven cellulose fibers or other fibrous mat. Alternatively, the disc of tobacco sheet can be reinforced with cellulose fibers which are optionally continuous. In addition, the tobacco disc, whether or not including a base, can be reinforced by circular or radially extending segments from other materials as discussed in incorporated application Ser. No. 08/105,346. Suitable binders include cellulose gums, starches, pectins, alginates, konjac flour, PVA's and EVA's, dextrins and dextrans and other conventional binders.

Disc 112 is located within a case or housing 114 having sufficient rigidity for insertion into the receiving area or receptacle of the permanent portion 20 with proper registry between heater element 32 and disc 112 and between the hub 118 of disc 112 and the drive capstan 72 of the disc movement system 70, as well as sufficient rigidity for subsequent removal of the disc for disposal, storage when not inserted, transport, etc. For example, housing 114 may be constructed from hard paperboard, cardboard, plastic or some combination thereof. The housing 114 can have suitable retention mechanisms, e.g., couplings, bumps, extensions, grooves or slots, which engage with corresponding structure in portion 20.

Figure 2:
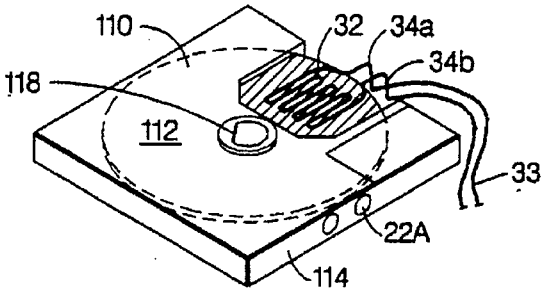
FIG. 2 is an elevational view of a tobacco-bearing disc and associated housing and heater.
Figure 4:
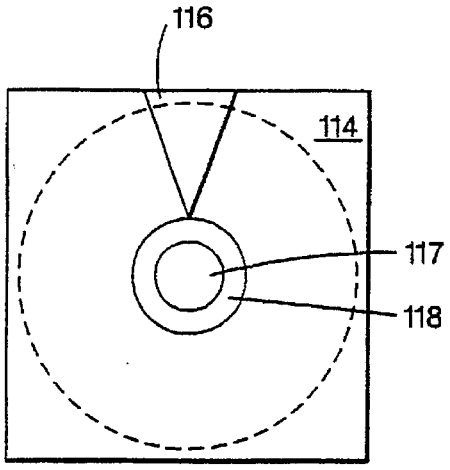
FIG. 4 is a top view of the disc housing according to the present invention.

In one embodiment, disc housing 114 is provided with a suitable window or opening 116 as shown in FIG. 4 for permitting an unused tobacco portion of the disc to be rotated into thermal proximity, i.e., registry, with heater 32. Opening 116 may optionally be fitted with a door which is closed prior to insertion of the disc to the receiving area of the permanent portion and which is opened when the smoker puffs, as is employed in, e.g., the art of computer discs. The opening 116 also permits the evolved tobacco flavors to be entrained with the ambient air drawn through ports 22, as shown in FIG. 1. Alternatively or additionally, as shown in FIG. 2 air ports 22*a* are provided in tobacco supply housing 14 which communicate with ambient air ports 22 in the lighter housing 20. If no window is provided, additional air outlets are provided in housing 14 which communicate with flavor delivery system 130.

Disc 112 and housing 114 are each provided with apertures or hubs, which are preferably concentric relative to the disc, for engagement of the disc 112 with a drive capstan 72 of the disc movement system 70 located in the lighter. In the view of FIG. 4, housing 114 has an aperture 117 located through the housing such that drive capstan or axle 72 passes therethrough for rotatable engagement with the hub 118 of the disc.

Disc 112 comprising tobacco is a suitable size for delivering the desired number of puffs per disc. A relatively small disc having outer diameter of 47 mm and a hub diameter of 12 mm has a maximum useful surface area of approximately 1621 square mm. Assuming that the disc is comprised of reconstituted tobacco and further assuming that each satisfactory puff requires between approximately 15 and 20 square mm, and specifically assuming 20 square mm, of reconstituted tobacco, then such a relatively small disc yields up to approximately 81 puffs. Using the same parameters and assumptions, a relatively large disc of reconstituted tobacco having an outer diameter of 88 mm and a hub diameter of 24 mm has a maximum useful surface area of approximately 5630 square mm, which yields approximately 281 puffs. By way of comparison, a more conventional pack of 20 cigarettes yields between approximately 140 and 160 puffs, assuming 7–8 puffs per cigarette. The size of the disc employed significantly influences the size of the lighter 10, which is preferably hand-held.

The disc window 116 of the disc housing 114 may have any suitable shape to ensure registry with the heater 32 to permit generation of the desired smoke when the smoker puffs. To optimally utilize the useful surface area of a circular disc 112 as described, a pie-piece or wedge shaped window as shown in FIG. 4 is preferred rather than a square or other geometric shape. The portion of the disc 112 registered with the heater 32 is defined by edges of the window 116 which extend radially outward relative to the disc 112. In the case of the described relatively small disc 112, each pie-slice window 116 would have an apex angle of approximately 4.4° to result in the required registered area of approximately 20 square mm. In the case of the described larger disc 112, the pie-slice window 116 would have a apex angle of approximately 1.4° to result in the required registered area of approximately 20 square mm.

The provision of a pie-shaped registry via an appropriately shaped access window 116 and heater 32 permits a circular heating path to be employed as the disc 112 rotates in the desired direction to expose an unused portion for heating and to remove a neighboring used portion from registry. Such a circular path optimizes use of the available disc surface area and simplifies registry. Radial spacings, e.g., non-tobacco portions, may be provided between the tobacco portions to compensate for possible registry misalignments while avoiding nonuse of any misaligned or nonaligned tobacco portions. Preferably, the rotation of the disc 112 occurs immediately after each puff, assuming an initial registry for the first puff, to avoid any possible drawing of off-tastes from a previously heated portion upon subsequent puffing.

The puff sensor 26 is located within the disc chamber which can be sealed after accepting the disc. As shown if FIG. 5, the sensor 26 alerts the control circuit 50 when the smoker draws on the first end of the mouthpiece section 132. The control circuit 50 and associated logic can comprise that disclosed in incorporated U.S. Pat. Nos. 5,060,671 and 5,388,594 and U.S. patent application Ser. Nos. 08/380,718 and 08/105,346. The control circuit 50 first sends a signal to activate heater 32 for heating of the tobacco. More specifically, the activated heater 32 heats the registered and unused pie-shaped section or wedge of disc 112 and generates the desired flavors, which are drawn via a mouthpiece section to the smoker. In addition, the control circuit 50 sends a signal to update any visual indicators 28.

Also, the control circuit 50 sends a signal to advance the rotation of the disc 112 or the heater 32 relative to the disc after a sufficient time has passed for the generated flavors to be drawn in by the smoker. The drive axle 72 is preferably driven by a small electrical motor and associated gearing 24 powered by battery 25 and controlled by control circuitry 50. Alternatively, the drive axle may be driven by use of energy stored in a spring and released in a step-wise fashion. Alternatively, the drive axle and associated disc may be rotated manually by the smoker in a manner similar to that described in U.S. patent application Ser. No. 08/105,346.

In an alternate embodiment, a stacking mechanism is employed to store both nonregistered used and nonused discs 112 and to convey a single disc 112 to the heater 32 for registry. Multiple planar discs 112 are optionally contained in respective disc housings 114. The discs 112 may be initially stacked in a magazine. The magazine could comprise a magazine housing having slot extensions extending from its oppositely located side walls to form respective slots for each disc housing 114 inserted therein. A disc engagement system may be employed to convey a first disc 112 from the magazine to engagement with a drive capstan or axle. An unused portion of this engaged disc 112 is exposed to the heater via the housing window 116. After puff activated heating, the first disc 112 is rotated as described above and the puffing process repeated until the entire disc has been used. After the last wedge of the first disc 112 is heated, the control system activates the disc engagement system to convey the first used disc 112 back into its slot in the magazine and then to convey a second unused disc 112 for the magazine to register with the heater 32. This is continued until all discs in the magazine are used. Such a configuration provides a greater number of puffs to the consumer without the need to reload the lighter with discs. Optionally, a carousel arrangement can be employed. This multiple disc mechanism can employ various arrangements conventionally found in storage and transfer mechanism for record players and/or compact discs which move the recorded media into and out of registry with the stylus or laser.

Figure 6A:
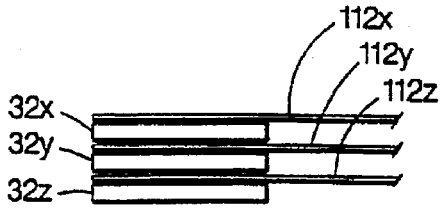
FIG. 6A is a side view of an embodiment of the present invention employing multiple discs and heaters.

A further embodiment is shown in FIG. 6A employing a plurality of stacked discs 112*x*, 112*y*, 112*z*. The discs are all hub-engaged with a drive capstan such that the disc stack rotates together. Each of the stacked discs has an associated fixed heater 32*x*, 32*y*, 32*z*, etc., which is in registry with a respective unused portion of each disc via respective housing window. Although all discs have a respective portion registered with an associated heater throughout the use cycle, preferably only one heater is activated via a particular puff. Preferably, one heater is activated successively to heat its associated disc entirely as described above, then another heater is activated, and so forth until the entire disc stack is used.

Figure 6B:
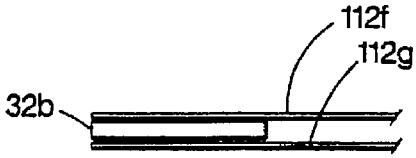
FIG. 6B is a side view of an embodiment of the present invention employing multiple discs and a single heater.
Figure 5:
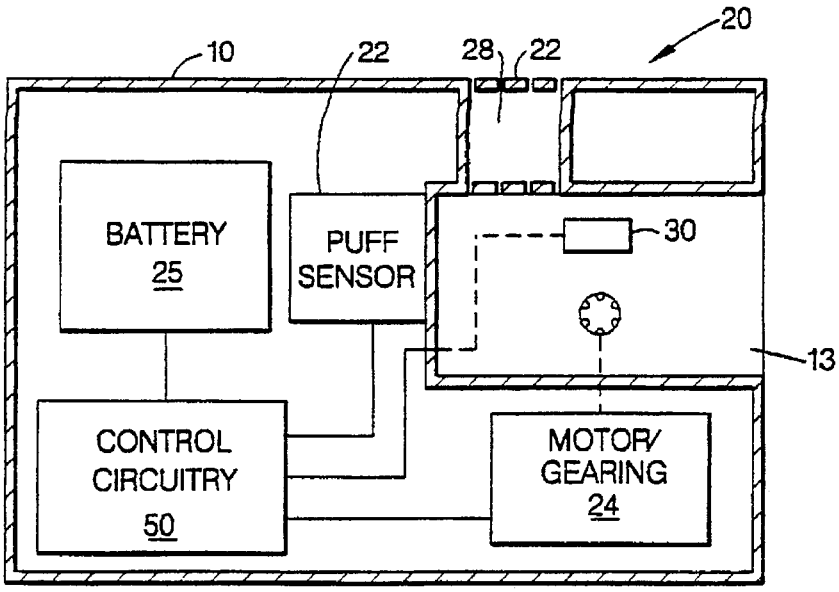
FIG. 5 is a schematic view of the lighter according to the present invention.

Another embodiment is shown in FIG. 6B and employs two single discs 112*f* and 112*g* located on opposite sides of a two sided heating element 32*b*. Two sided heating element 32*b* preferably comprises a single heating element supported by a frame or optionally comprises two heating elements located on opposite sides of a common substrate. The single or dual heating elements preferably have the serpentine-shapes described above. The two discs 112*f* and 112*g* are arranged such that each of the housing windows are in registry with the single, two sided heater. In this embodiment, each window is sized to provide half of the area required to generate an acceptable puff, e.g., each window defines an area between approximately 7.5 and 10 square mm., and the exposed areas of the two discs 112*f* and 112*g* combine to form the generated puff. In this embodiment, both discs 112*f* and 112*g* engage a single associated drive axle or capstan, and smoke generated from the two discs is fed along a common delivery system to the smoker via the mouthpiece. By employing such a configuration, improved efficiency is obtained over a configuration requiring an associated heater for each disc since each of the two sides of heating element 32*a* is in registry with an associated disc 112*f* and 112*g*, i.e., one side of the heater is not underutilized by facing a substrate or other non-tobacco element.

Figure 7:
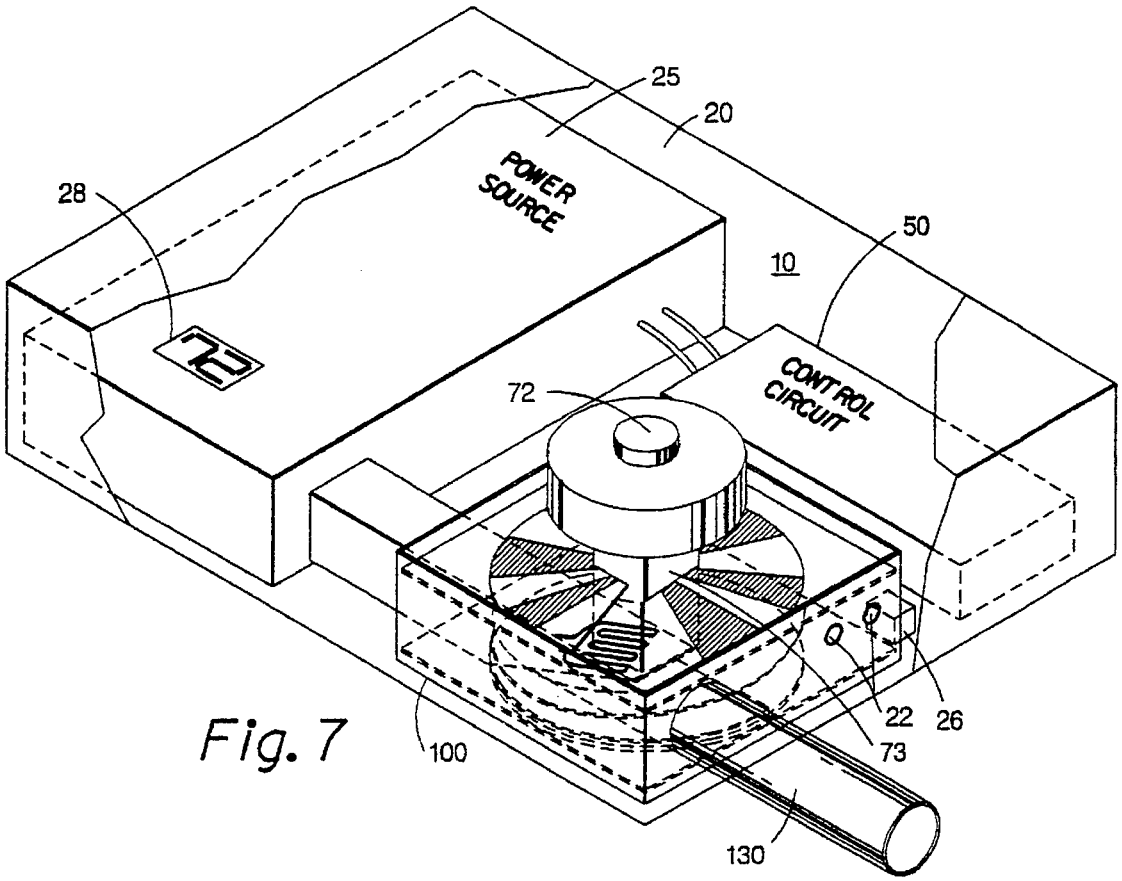
FIG. 7 is an exposed elevational view of the present invention comprising a tobacco-bearing spiral and associated registry system.

Another preferred helical spiral embodiment of the present invention is depicted in FIGS. 7, 8, 9, 10A, 10B, 10C, 11A, 11B, 12A, 12B, 12C, 13A, 13C, 14, 15A and 15B and provides an increased supply of tobacco while simplifying the construction of the delivery system by avoiding the need for multiple drive capstans, conveying systems, and multiple heaters. As best shown in FIG. 7, this embodiment comprises many of the features of the above described disc embodiment, wherein like numbers in the figures refer to like elements. Air ports 22 are provided in the housing 20 and portion 100 to communicate drawn ambient air across the section of tobacco being heated, as described above. This helical spiral embodiment can employ the same power source 25, control circuitry 50 and other elements as discussed above.

In contrast, a helical or spiral structure 113 is employed comprising tobacco or a tobacco bearing substrate. Preferably, reconstituted tobacco is used to compose the structure 113. The helical shape can be formed by cutting a circular or other endless disc radially and then relatively raising and lowering the radially cut disc at the point of separation to form a single turn spiral. The multiple discs are cut and joined together at the respective cut end sections to form a spiral having multiple turns. These spiral discs may be attached end-to-end or located such that their ends abut to form a multiple turn spiral. Preferably, the spiral is formed as discussed below with reference to FIGS. 11A, 11B, 12A, 12B, 12C, 13A and 13C.

Figure 8:
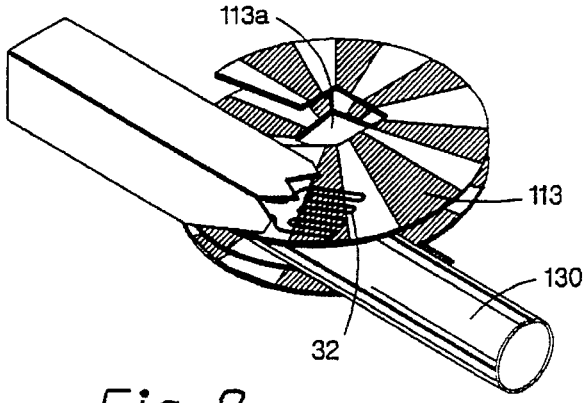
FIG. 8 is an elevational view showing the tobacco-bearing spiral of FIG. 7 and an interposed mouthpiece section.

Referring to FIGS. 7, 8, 9, and 10A, in one embodiment the helical structure 113 is journaled on a rotating drive axle 73 such that as axle 73 rotates, the spiral structure 113 rotates and advances along axle 73 in a longitudinal direction, as described in greater detail below. The drive axle 73 is in turn mated with and driven by drive capstan 72. The surface of the spiral structure 113 is thus pitched relative to the drive axle 73 at a particular screw angle. As shown in FIG. 8, the heater 32 is also oriented at this screw angle such that the heater 32 and a portion of the spiral structure 113 are in a parallel relationship for registry. After a puff activated heating, the generated flavors are conveyed to the smoker as described previously. The drive axle then rotates a predetermined amount to register another unused portion of tobacco of spiral structure 113 with the heater 32. Accordingly, a system is provided wherein, depending on the rotational direction of the axle 73 and the orientation of the lighter 10, used portions are located either above or below the pitched heater 32, an unused portion is in registry with the pitched heater 32, and the remaining supply of unused portions are either below or above the pitched heater 32.

Figure 9:
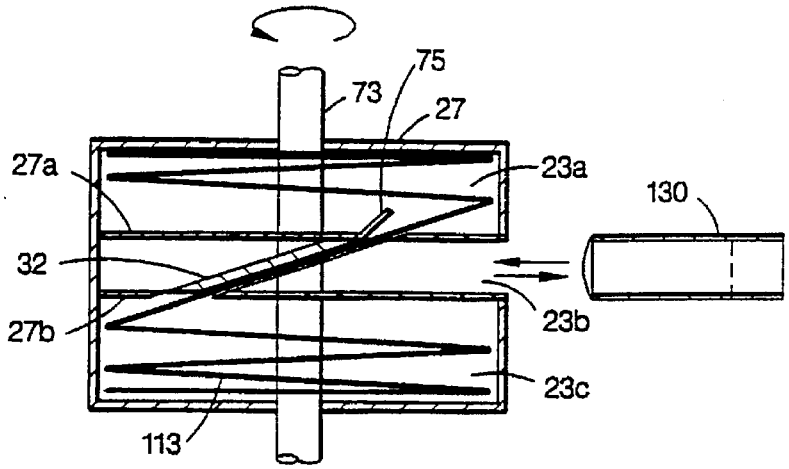
FIG. 9 is an exposed side view showing a tobacco-bearing spiral and associated housing chambers.

A preferred embodiment best shown in FIG. 9 comprises a housing 27 which encloses the spiral disc 113 and the drive axle 73 to form a discrete element which is insertable into the lighter 10 and which is removable for disposal. This housing 27 is preferably circular and divided into three successive circular chambers, namely, a supply chamber 23*a*, a heater registry chamber 23*b* and a disposal chamber 23*c*. The three housing chambers are separated from one another via respective interior walls 27*a* and 27*b* except for access apertures for the drive axle 73 to pass therethrough and for the helical structure 113 to spiral from one chamber to the next. The housing 27 is preferably transparent, e.g., plastic, to permit visual inspection of the various supply levels in the chamber 23*a* to supplement the provided puff counters or indicators 28 and to permit the smoker to check the supply level if the housing 27 is removed and then visually evaluated for adequate supply and consequent reinsertion. Preferably, coaxial apertures are located through the inner walls for the drive axle 73 to pass therethrough, and separate apertures are located for the spiral structure 113 to pass therethrough. Such a configuration minimizes exposure of the supply of unused portions of tobacco to generated smoke and effectively moves the used portions to the disposal chamber 23*c* to trap and isolate any undesired ashes, smells, etc. from the nonused portions. Also, a convenient enclosure is provided for the tobacco prior to the insertion into the lighter 10, during its interface with lighter 10, and for subsequent disposal. The housing 27 is provided with air inlets which communicate drawn ambient air to heater registry chamber 23*b*, i.e., these air inlets communicate with air ports 22 and are located through the wall(s) of housing 27 to communicate drawn air with chamber 23*b*, similar to air inlets 22*a* discussed above and below. The flavor delivery system 130 also communicates with chamber 23*b* to deliver generated tobacco flavors to the smoker as discussed above and below.

As shown in FIG. 9, a separation finger 75 is provided in housing 27 between supply chamber 23*a* and disposal chamber 23*c* to widen the spacing between two adjacent turns or levels of the spiral structure 113 immediately prior to the heater 32 so that the turn closest to the heater 32 is raised into proper registry with heater 32. A second separation finger (not shown) can optionally be provided to close the spacing after heating between two turns immediately past heater 32. Such separation and closing of the turns permits the used and unused portions to be tightly compressed into respective stacks in the supply chamber 23*a* and the disposal chamber 23*c* to maximize the available supply of tobacco. The separation finger(s) 75 extend inwardly from the housing wall. Alternatively, rollers are employed to separate and compress the advancing spiral turns.

The helical tobacco structure 113 can be sized for any desired puff count. For example, the helical tobacco structure can provide a surface area sufficient to provide a number of puffs equivalent to a conventional package of 20 cigarettes. The heater 32 can also be sized to extend across the spiral uniformly and can accordingly be serpentine-shaped with a constant amplitude to register with the portion of tobacco required for an acceptable puff. Alternatively, one of the wedge-shaped heaters, i.e., a serpentine-shaped heater with the amplitude of FIG. 3C or FIG. 3D relative to the registered spiral, as described before can be employed. A heater support plate 33*b*, shown in FIG. 13B, can be disposed opposite the heater 32 in chamber 23*b* such that the spiral 113 lies therebetween to hold the spiral 113 against the heater 32.

Figure 10A:
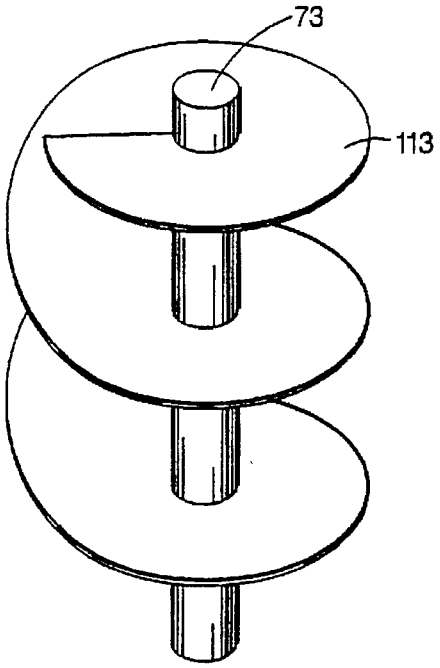
FIG. 10A is an elevational view of a tobacco-bearing spiral and associated drive axle.
Figure 10B:
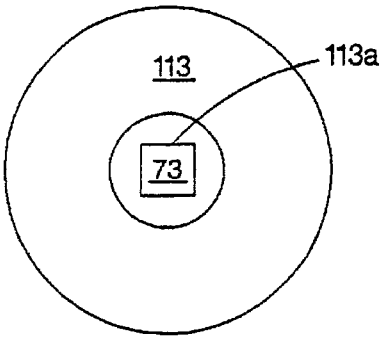
FIG. 10B is a top view of a tobacco-bearing spiral and associated drive axle.
Figure 10C:
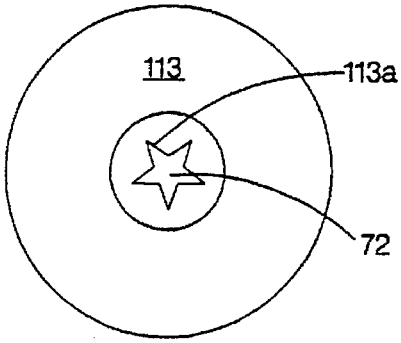
FIG. 10C is a top view of a tobacco-bearing spiral and associated drive axle.

The helical tobacco structure 113 is preferably spiralled along the drive axle 73 by using the center 113*a* of the helix as a drive mechanism as shown in FIG. 10A. The spiral tobacco structure 113 grips the drive axle 73 to rotate therewith and advance axially along the drive axle 73 to move from one chamber to another. Accordingly, both the drive axle 73 and the central hub on 113*a* of the helical structure 113 are preferably comprised of discrete angled sections rather than integral curved sections. For example, the drive axle 73 may have a square or rectangular shaped cross section. The central hub 113*a* likewise would have linear interior edges angled with respect to each other at every quarter, i.e., 90°, of the spiral turn to form a square when viewed from above, as shown in FIG. 10B. Similarly, as shown in FIG. 10C, the drive axle 73 can have other multiple angled cross-sections such as a five pointed star or any suitable polygon such that the appropriate corresponding hub 113*a* of the spiral structure 113 is driven in the desired direction by rotation of the drive axle without any undesired slipping. In more general terms, the drive axle 73 has an outer surface which mates with the hub 113*a* of the helical structure 113 and which comprises a number of adjacent equally sized faces. The number of drive axle outer faces is selected such that it is equal to the number of angled adjacent spiral hub inner faces which comprise a single 360° turn of the spiral hub 113*a*. For example, the square axle 73 of FIG. 10B has four outer faces, and hub 113*a* has four corresponding inner faces which constitute a single 360° turn of the spiral hub. A key feature is that both the axle and hub are shaped such that as the axle rotates, the tape or spiral rotates and moves vertically or axially, i.e., spirals, along the axle. In an alternative embodiment, axle 73 and hub 113*a* define a threaded drive arrangement.

By employing a three chambered housing 27, a suitably configured drive axle 73 and mating central spiral hub 113*a*, a continuous helical supply of tobacco is presented to the heater 32. The helical supply can be joined cut discs as discussed above. Alternatively, a supply of single spirals can be provided, each spiral made by cutting a circular or other shaped disc. Preferably, the unused portions of tobacco in supply chamber 23*a* and the used portions in disposal chamber 23*c* are compressed relative to the registered sections within registry chamber 23*b* to optimize space requirements. Also, approximately 180°, i.e., a half-turn, of the spiral is separated from the compressed supply in supply chamber 23*a*; approximately 360°, i.e., a full turn, of separated spiral is present in registry chamber 23*b*; and another half-turn is present in disposal chamber 23*c* along with the compressed used portion.

Figure 11A:
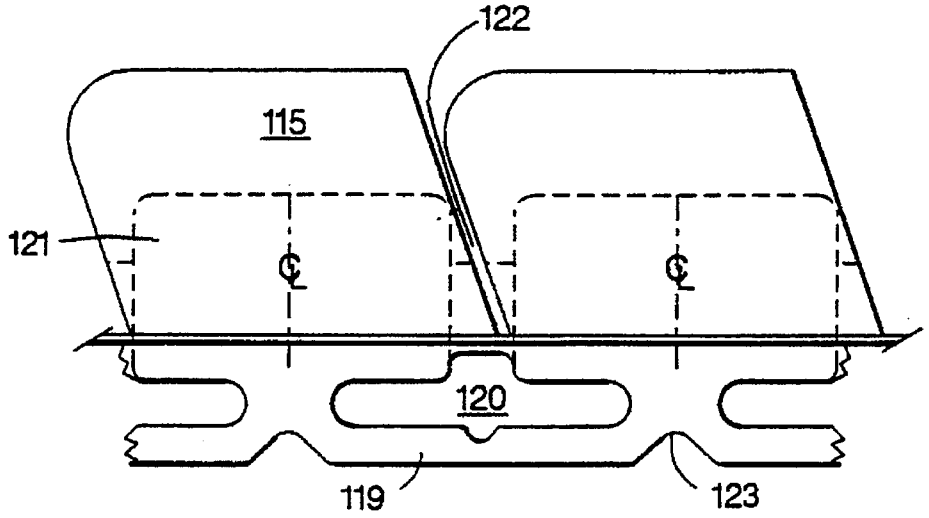
FIG. 11A is a top view of a straight indexing track bearing tobacco panels.
Figure 11B:
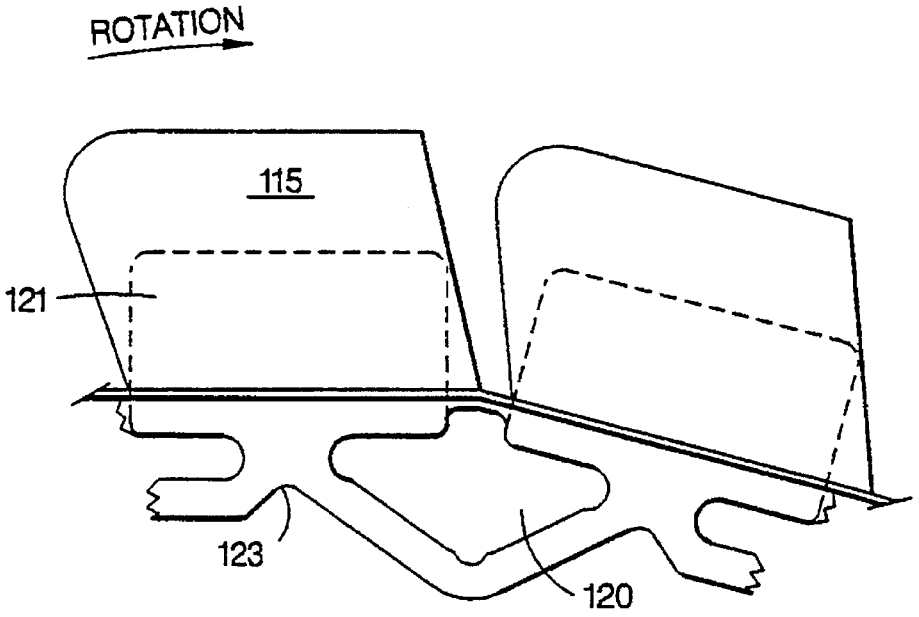
FIG. 11B is a top view of two adjacent links which comprise the track of FIG. 11A bent into a spiral shape.

A particularly preferred embodiment is shown in FIGS. 11A, 11B, 12A, 12B, 12C, 13A and 13B which is preferably housed in a three chambered housing 27 as discussed above. Referring to FIGS. 11A and 11B, the spiral shaped tobacco supply 113 comprises a plurality of tabs 121, each bearing a respective tobacco pad 115. The tabs 121 are preferably comprised of a material which provides a sufficient mechanical strength to support tobacco pad 115 and to be advanced and compressed as discussed, especially after heating. For example, aluminum or steel is suitable. Each tab 121 is preferably provided with a plurality of holes 121A by, e.g., cutting the hole out cleanly with no burrs or alternatively punctured to provide metal eruptions or protrusions around the hole edge. Preferably, the holes are punctured alternately from each side. The protrusions provide an adhering surface for applied tobacco in the form of tobacco pad or patch 115. Alternatively, tobacco panel 115 is comprised of integral tobacco mat of e.g., reconstituted tobacco, and is preferably reinforced, e.g., with cellulose as discussed above, or any of the webs described in the incorporated application Ser. No. 08/105,346.

The tabs 121 are preferably affixed or integral to a track 119 defining a plurality of indexing links 120. As shown in FIG. 11A, track 119 is initially configured such that the successive indexing links 120 and associated extension tabs 121 extend linearly with respect to one another. Track 119, including if desired associated extension tabs 121, is preferably manufactured from an integral, e.g., aluminum, stainless steel, plastic or paper, strip. Indexing links 120 are cut and preferably have an initial shape with rounded edges.

The respective extension tabs 121 are cut to extend from one edge of the track 119 to be interposed between successive indexing links 120 and have a gap 122 therebetween. In one embodiment, the opposite edge of track 119 is provided with bend gaps 123 defined by two track edges defining an initial shape of an equilateral triangle and located between successive indexing links 120 such that an imaginary line extending from the apex of the triangle approximately bisects the center line of the oppositely located extension tab 121.

Tobacco panels 115 are then affixed at an edge to respective extension tabs 121 by, e.g., an appropriate adhesive such as resins, sodium carboxymethynyl cellulose, cellulose gum, pectins or other appropriate binders such as those described herein and those available from Aqualon Co. of Hopewell, Va., such that the majority of the tobacco panels 115 extend past the extension tab 121 for ultimate registry with the heater 32 and such that unnecessary heating of tab 121 is avoided.

The straight track 119 is then bent into a spiral pattern as shown in FIG. 11B such that the indexing links 120 have a general arrowhead shape. The resulting spiral structure is shown in FIG. 13A wherein tobacco bearing panels 115 extend outward from the periphery of the spiralled track 119.

Figure 13A:
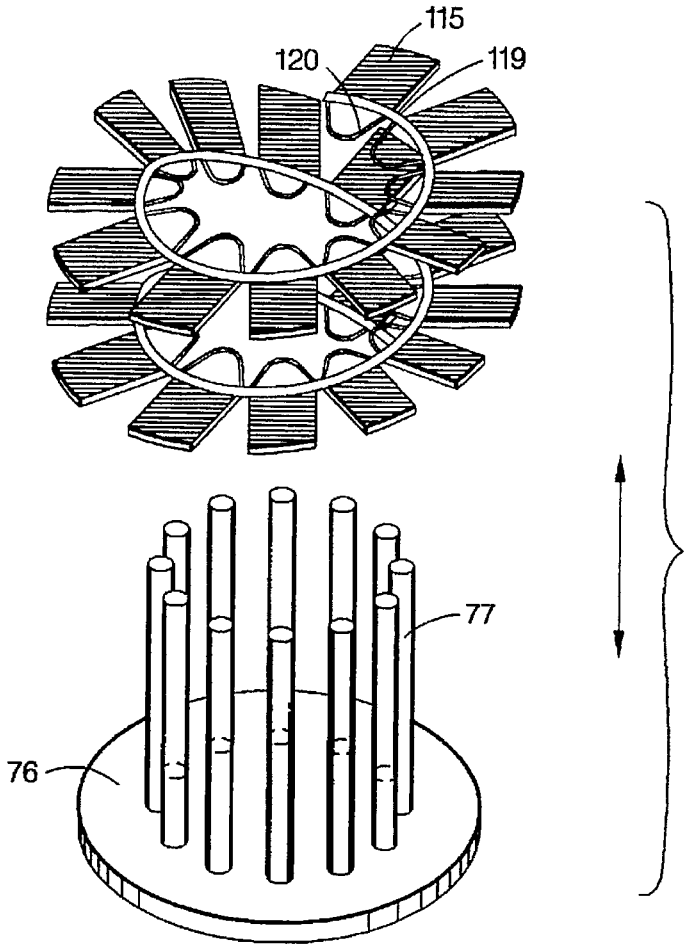
FIG. 13A is an exploded perspective view of a spiral track bearing tobacco and a pin assembly.
Figure 13B:
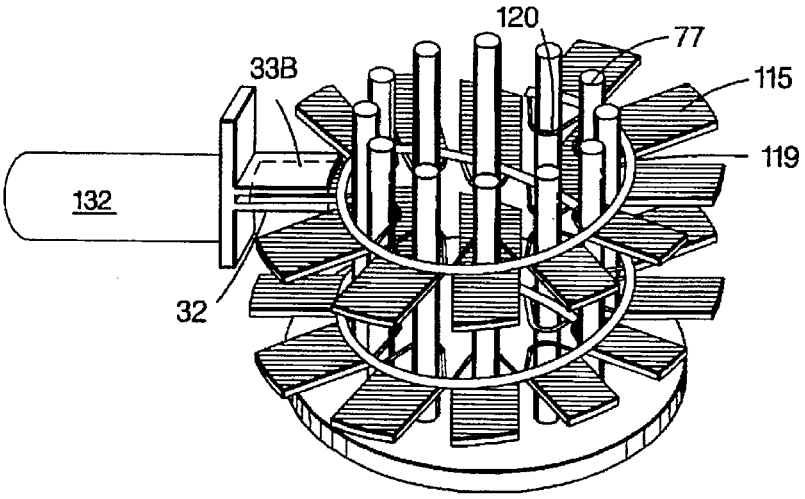
FIG. 13B is a perspective view of the components of FIG. 13A in operative combination with a heater and mouthpiece.

To mate with this spiralled track 119, a plurality of pins 77, e.g., six, eight or twelve pins, engage the indexing links 120, as shown in FIGS. 13A and 13B. More specifically, the plurality of drive pins 77 are respectively connected at a first end to a support plate 76 which is located in one of the chambers 23*a* or 23*c* and is connected to, and rotates with, driven axle 73. Support plate 76 is preferably circular and in any event pins 77 are arranged such that they define a circular or other endless pattern as shown in FIGS. 13A and 13B to provide a travel path for track 119 bearing the tobacco. As seen in FIG. 13B, the track 119 is spiraled around the pins 77, i.e., a respective indexing link 120 engages a respective pin 77 such that a successive panel 115 is at a slightly incremented position on its associated pin 77 relative to the preceding and following panels 115 located on their associated pins 77 to define the screw angle. This spiraling is more pronounced, i.e., the distance between successive turns is greater, during registration with the heater 32 in chamber 23*b* . For example, a housing 27 as shown in FIG. 9 is preferably employed with this embodiment. The guide finger 75 will aid in positioning the track 119 along the axial length of the pins 77, as discussed above with reference to FIG. 9.

The support plate 76 is preferably located in the supply chamber 23*a* such that the relatively compressed turns of spiral track 119 are adjacent to the support plate. Support plate 76 is provided with a hub which engages drive axle 72. As drive axle 72 incrementally rotates the support plate 76, the track 119 spirals and is translated away from support plate 76 along respective pins 77. As before, each incremental rotation—after any initial rotation to achieve heater registration—preferably advances a successive unheated panel 115 into registry with the heater 32 and advances the heated panel to the storage chamber 23*c*. This incremental rotation preferably occurs after a predetermined energization period for heating a panel 115 to generate smoke, and preferably occurs at the end of this period.

Figure 12A:
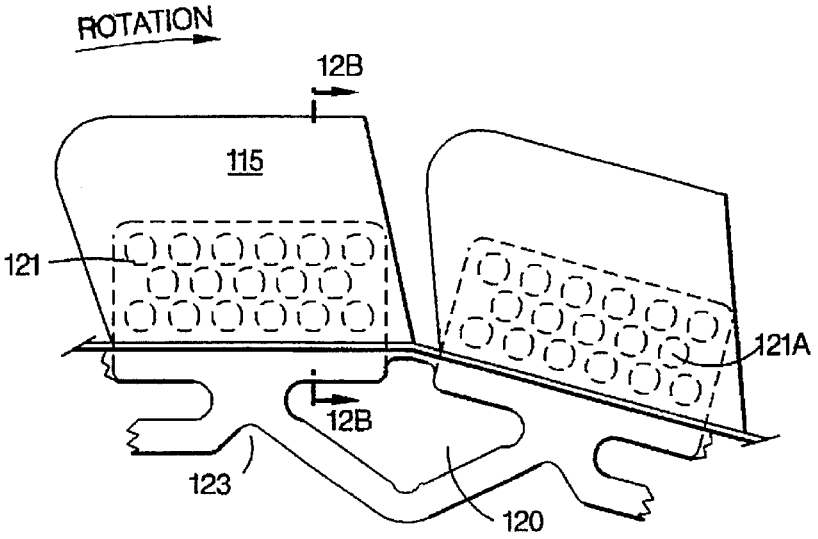
FIG. 12A is a top view similar to FIG. 11B except that a supporting tab is provided with apertures.
Figure 12B:
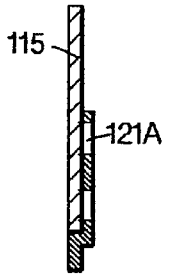
FIG. 12B is a side view taken along line B—B of FIG. 12A.
Figure 12C:
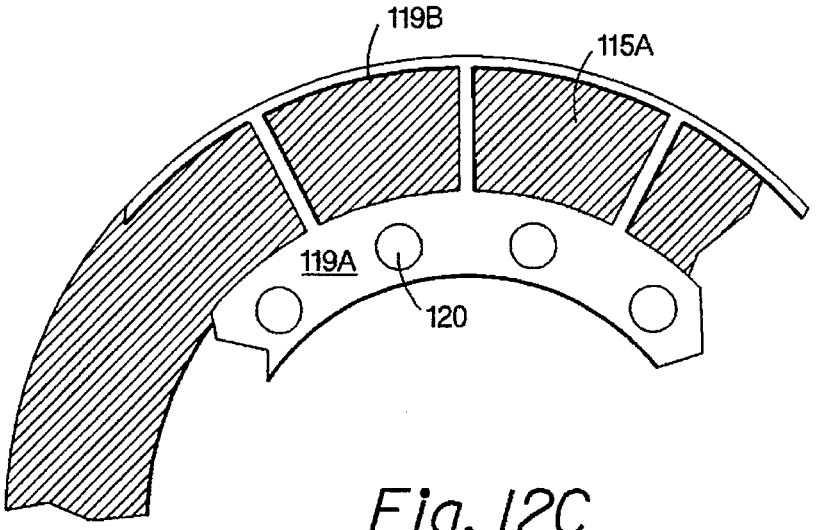
FIG. 12C is a top view of a portion of a tobacco-bearing spiral comprising radial apertures with tobacco inserted therein.

A further spiral arrangement is shown in FIG. 12C. Spiral track 119A defines a plurality of registry frames 119B overlying a spiral tobacco supply to define adjacent tobacco portions 115A for registry with a heater element. A plurality of indexing holes 120A are provided in spiral track 119A to engage with pins 77 as described above with reference to links indexing 120.

In all of the spiral arrangements, lead portions can be provided at the two ends of the spiral which do not register with the heater and thus do not need to bear tobacco. For example, one, and preferably both, of the leads is fixed to one of the chambers 23*a* and 23*c*, or to support plate 76, such that appropriate tensioning is applied during spiralling. The leads should be sized such that the initial and final portions of tobacco adjacent to the respective leads are heated.

Figure 14:
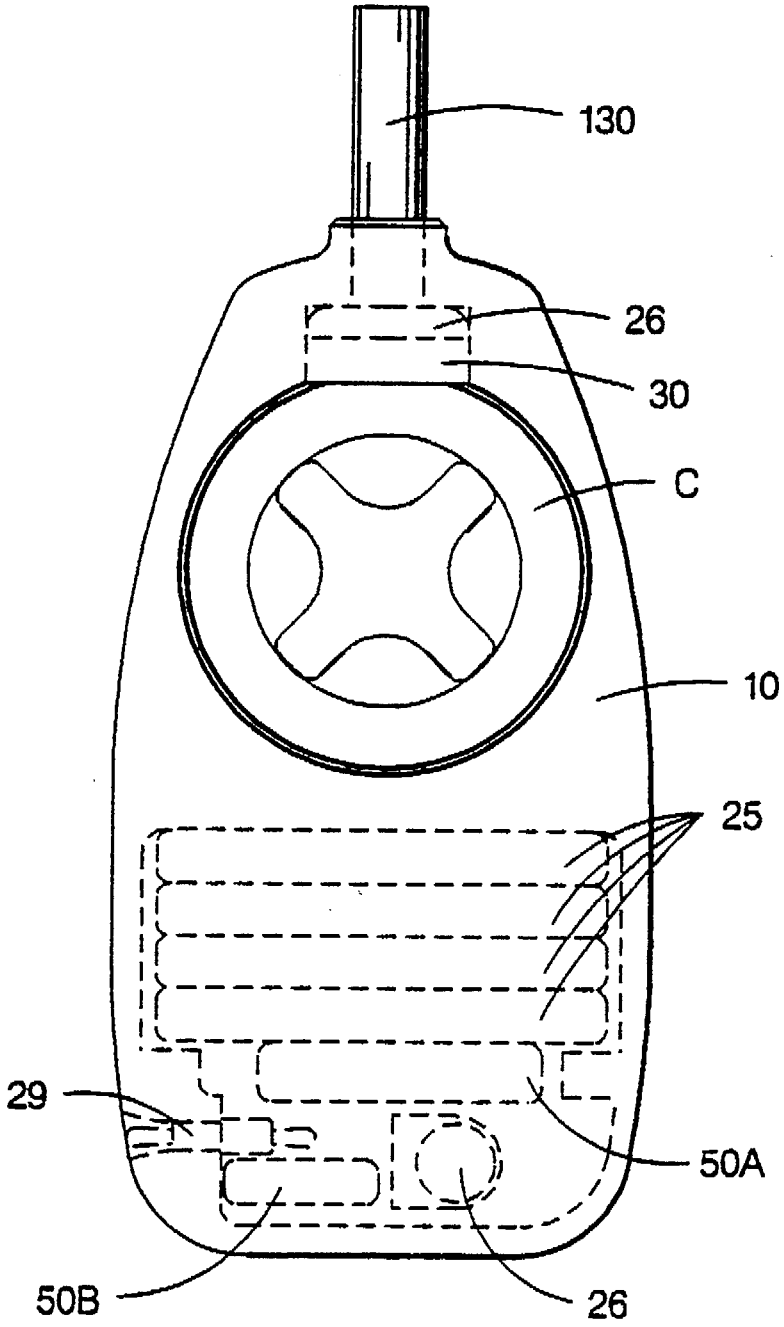
FIG. 14 is a top view of a preferred embodiment of a lighter according to the present invention.

Referring to FIG. 14, a particularly preferred configuration of the present invention is shown. The lighter 10 is intended to be hand-held and accordingly preferably has an outline which has a broader distal section (relative to the mouth of a smoker) and a narrower proximal section. This lighter outline defines a cavity, wherein the distal section contains batteries 25, puff sensor 26, control circuitry 50*a* and 50*b*, and a switch 29 provided to turn to lighter off during periods of nonuse to conserve battery power. Switch 29 and the proximal section contains a cartridge C containing tobacco in the form of a disc or spiral as discussed above and the heater system 30. A delivery system 130 as described is located at the proximal end.

The foregoing embodiments of the present invention employ resistively heated heating elements which heat tobacco in thermal registry therewith. Alternatively, induction heating systems can be employed as disclosed in commonly assigned, related application Ser. No. 08/225,120, which is incorporated in its entirety. A susceptor material is in thermal contact with the tobacco and is heated by an alternating magnetic field generated by an induction source, whereby the tobacco is heated to evolve tobacco flavors. The susceptor material can be interspersed with the tobacco of the disc, spiral or tabs disclosed herein, or can be a separate layer in laminate relationship therewith to further function as a mechanical support, or can be a separate, non-movable element which contacts or is in thermal relationship with the rotating supply of tobacco. For example, extension tabs 121 can extend underneath the majority under tobacco panels 115 and can comprise a suitable susceptor such as aluminum, conductive carbon, graphite, stainless steel, copper, bronze, or any combination thereof. Similarly, a substrate is provided for tobacco disc 112 and comprises such a suitable susceptor.

The induction source in preferably oriented such that the generated alternating magnetic field perpendicularly intersects the susceptor. For example, if a laminate susceptor is employed, e.g., in a spiral arrangement, the induction source, e.g., a E-shaped pole piece, is oriented perpendicularly to the screw angle, i.e, the legs of the E-shaped pole piece are perpendicular to the screw angle.

Figure 15A:
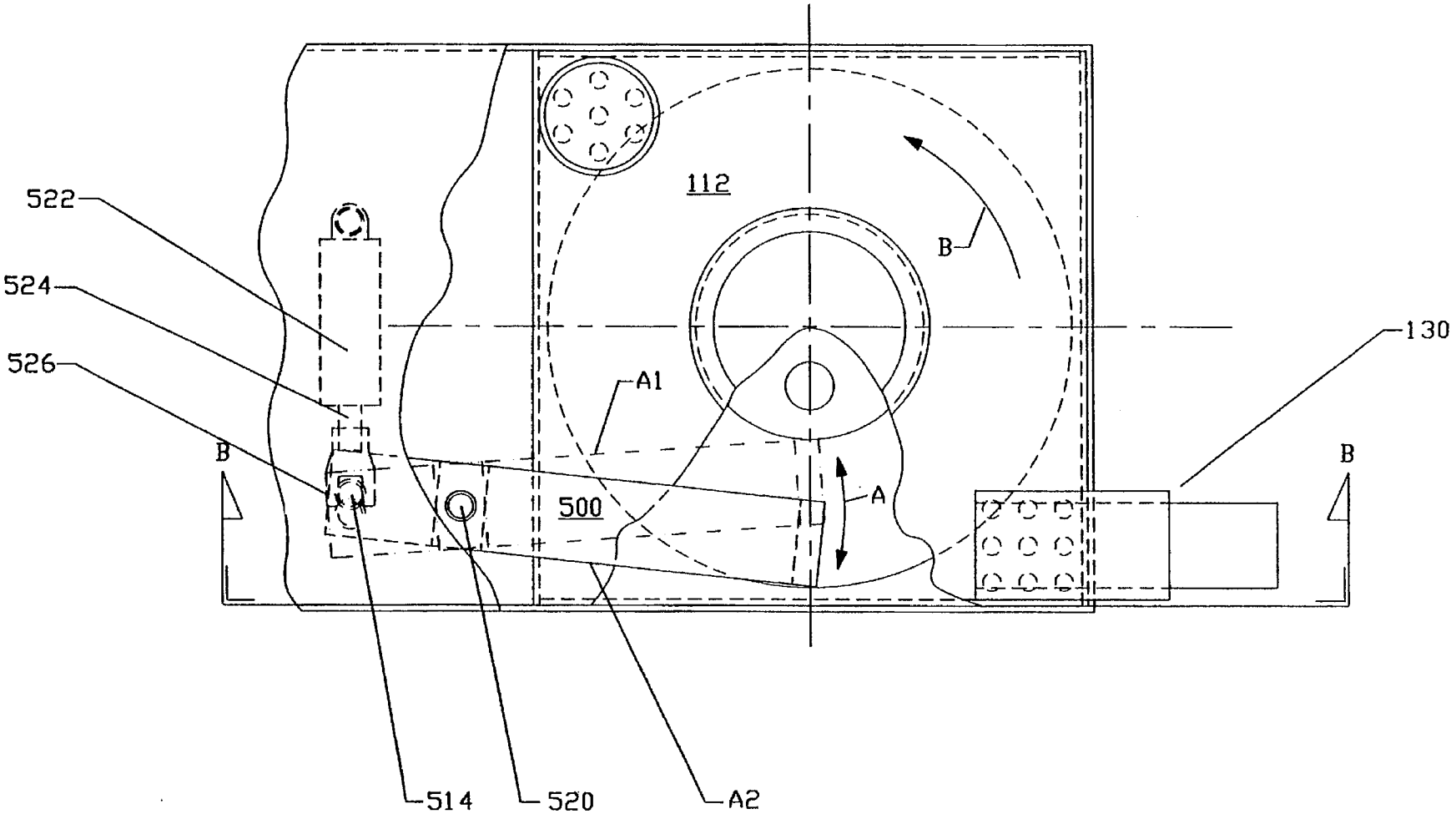
FIG. 15A is an exposed top view of an embodiment of the present invention employing a tobacco disc and a pivotal induction heater.
Figure 15B:
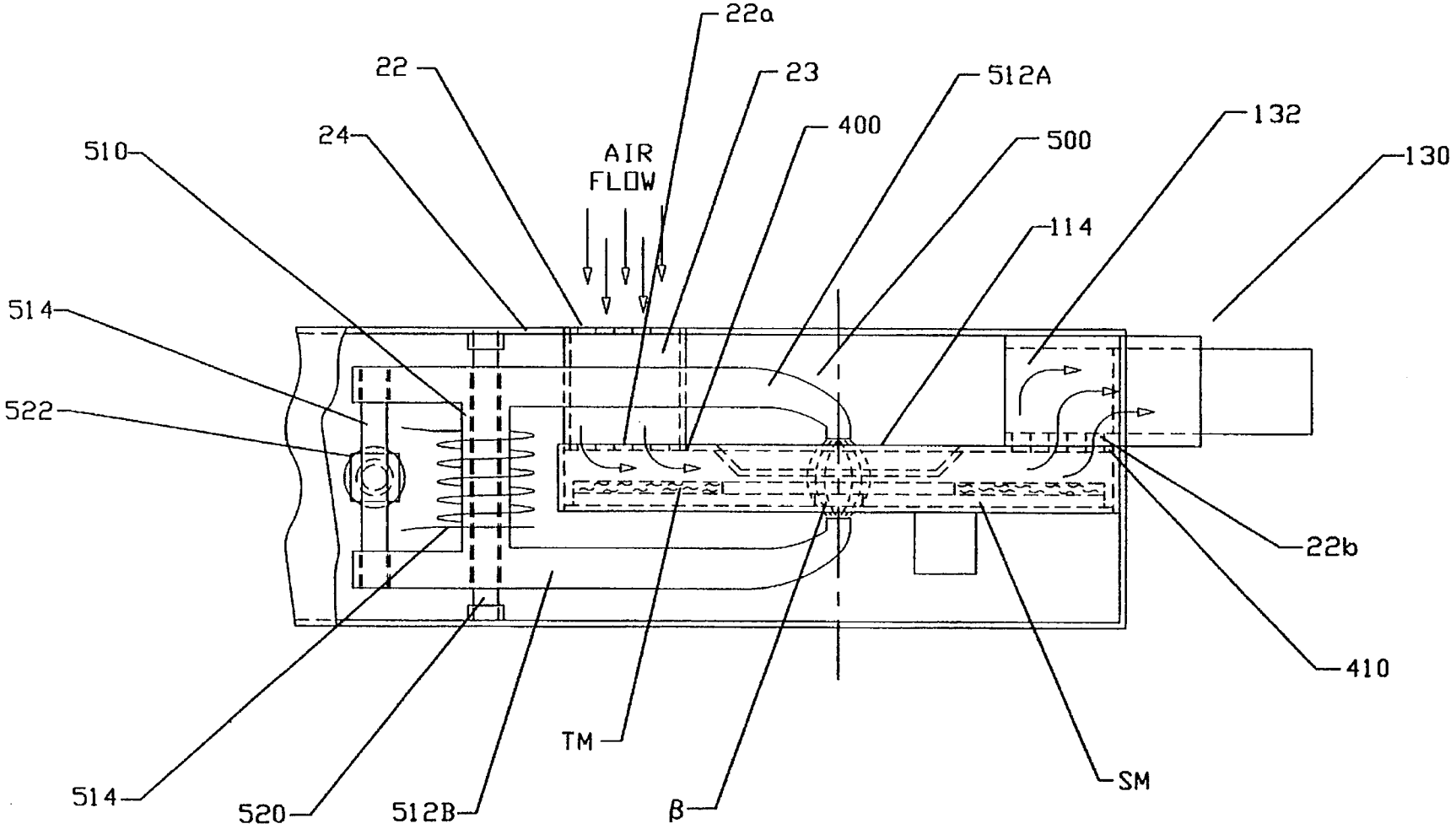
FIG. 15B is an exposed side view taken along line B—B of FIG. 15A.

Referring to FIGS. 15A and 15B, an induction heating source comprises a pole piece 500 comprising a central leg 510 connected end to end between two outer legs 512A and 512B extending generally perpendicularly thereto. A wire is wound as an induction coil 514 about central leg 510 and is connected to an appropriate circuit to generate an alternating magnetic field, as more fully described in related application Ser. No. 08/225,120, which is incorporated in its entirety. More specifically, the alternating magnetic field is generated between respective first ends of outer legs 512A and 512B. These first ends preferably are closer together than the generally parallel middle portions of the outer legs connected to central leg 510. For example, each outer leg 512A and 512B can arch inwardly toward the other, and toward interposed disc housing 114 containing tobacco disc 112, such that the first ends are in a substantially parallel, face-to-face relationship with the disc located therebetween.

The pole piece 500 is movable relative to the disc housing 114 and the contained tobacco disc 112 such that the alternating magnetic field β generated between the facing first ends of legs 512A and 512B is registered radially along the tobacco disc 112, which in turn is rotatable as discussed. Preferably, the disc housing 114 is relatively stationary, the tobacco disc 112 rotates and the pole piece 500 pivots as indicated by arrow A in FIG. 15A between a first inner circumferential position A1 indicated by a dashed line and a second outer circumferential position A2 indicated by the solid line. More specifically, a coaxial axle 520 passes through, and is preferably connected to, middle leg 510 of pole piece 500 and is pivotally journaled to permanent housing 20 of the lighter 10. A suitable pivot actuator 522, e.g., a two step motor, is fixed relative to pivotal pole piece 500, e.g., fixed to permanent housing 20, and comprises an extendable and retractable arm 524 having a mating element 526, e.g., a U-shaped mating element 526, connected to an end thereof. Mating element 526 mates with a cross leg 514 extending generally perpendicularly between legs 512A and 512B and generally parallel with middle leg 510. When actuator 522 retracts or extends arm 524, pole piece 500 is accordingly pivoted on axle 520 to inner circumferential position A1 or to outer circumferential position A2. This pivoting preferably only occurs once during the life cycle of a particular tobacco disc 112, e.g., the pole piece 500 is initially at inner circumferential position A1 during successive heatings and rotational advancements, indicated by arrow B, of respective disc portions and, upon heating of all the inner circumferential disc portions, pole piece 500 is then pivoted to outer circumferential position A2 for similar heatings and rotational advancements of successive portions, or visa versa. Pivot actuator 522 is connected to power source 25 and to control circuit 50 to preferably effect the pivoting after a predetermined number of puffs following insertion of disc 112. If a resistively heated element is preferred, the heaters 32 described in related application Ser. No. 08/225,120 and herein can be pivoted in a like manner.

As shown in FIG., 15B, air is drawn into the lighter via air ports 22 by the smoker drawing on the mouthpiece 132; travels across the tobacco TM heated by the draw actuated, inductively heated susceptor material.

Many modifications, improvements and substitutions will be apparent to the skilled artisan without departing from the spirit and scope of the present invention as described and defined herein and in the following claims.

We claim:

1. An electrical lighter for generating tobacco flavors from a tobacco supply, the lighter comprising:

a heater;

means for rotating a tobacco supply about an imaginary rotational axis such that respective sections of the tobacco supply are successively rotated about the imaginary rotational axis into registry with said heater to generate tobacco flavors and then rotated about the imaginary rotational axis out of registry with said heater; and means for drawing air across the heated section to deliver air and tobacco flavors to a smoker upon drawing by the smoker.

2. The electrical lighter according to claim 1, wherein said means for rotating the tobacco supply rotates the tobacco supply substantially in a plane relative to the imaginary rotational axis.

3. The electrical lighter according to claim 1, wherein said means for rotating the tobacco supply rotates the tobacco supply substantially in a plane which is angled relative to the imaginary rotational axis.

4. The electrical lighter according to claim 1, wherein said means for rotating the tobacco supply in a circular path relative to the imaginary rotational axis.

5. The electrical lighter according to claim 1, wherein said means for rotating the tobacco supply rotates the tobacco supply along a helical path relative to the imaginary rotational axis.

6. The electrical lighter according to claim 1, wherein said means for rotating the tobacco supply rotates the tobacco supply at a particular screw angle relative to the imaginary relational axis, wherein said heater and a section of the tobacco supply oriented at the particular screw angle are substantially parallel.

7. The electrical lighter according to claim 6, further comprising means for altering respective screw angles of respective sections of the tobacco supply.

8. The electrical lighter according to claim 7, wherein said means for altering alters the respective screw angle of a respective section of the tobacco supply to increase the respective screw angle when the respective section is in registry with said heater.

9. The electrical lighter according to claim 8, wherein said means for altering alters the respective screw angle of a respective section to decrease the respective screw angle when said rotating means rotates the respective section out of registry with said heater, wherein respective sections rotated out of registry with said heater are relatively compressed toward one another.

10. An electrical lighter for generating tobacco flavors comprising:

a disc comprising tobacco;

a heater;

means for successively registering respective sections of said disc in thermal proximity to said heater, wherein a section of said disc is heated to evolve tobacco flavors and a successive section is subsequently registered with said heater; and means for drawing air across the heated section to deliver air and tobacco flavors to a smoker upon drawing.

11. The electrical lighter according to claim 10, further comprising a disc housing for enclosing said disc, said disc housing having a window to permit registry between said disc and said heater.

12. The electrical lighter according to claim 11, wherein said window is defined by two edges extending radially outward relative to said disc, wherein said window is wedge-shaped to permit registry between a corresponding wedge-shaped portion of said disc and said heater.

13. The electrical lighter according to claim 12, wherein said heater comprises a wedge-shaped heating element electrically connected to the source of electrical energy, wherein said wedge shaped heating element is in registry with wedge-shaped portion of said disc via said wedge-shaped window.

14. The electrical lighter according to claim 10, wherein said heater comprises a wedge shaped heating element electrically connected to the source of electrical energy.

15. The electrical lighter according to claim 14, wherein said wedge shaped heating element comprises a serpentine shaped heating element having successively increasing amplitudes in a radially outward direction relative to said disc.

16. The electrical lighter according to claim 14, wherein said wedge shaped heating element comprises a serpentine heating element having an amplitude which increases from a first end to a maximum amplitude and then decreases to a second end.

17. The electrical lighter according to claim 10, wherein said means for registering comprises a drive capstan which rotates said disc, wherein said drive capstan is rotatably mated with a hub defined at a center of rotation of said disc.

18. The electrical lighter according to claim 10, wherein said heating element comprises a platinum heating element.

19. The electrical lighter according to claim 10, wherein said means for registering registers sections of said disc in an angularly sequential order.

20. The electrical lighter according to claim 10, wherein said heater comprises an induction heater for generating an alternating magnetic field to heat a suspecter in thermal registry with a registered section of said disc to heat the registered section.

21. The electrical lighter according to claim 10, wherein said heater comprises an induction heater for generating an alternating magnetic field to heat a suspecter in thermal registry with a registered section of said disc to heat the registered section, and further comprising means for adjusting said induction heater between at least two circumferential positions relative to said disc.

22. The electrical lighter according to claim 10, wherein said heater comprises an induction heater for generating an alternating magnetic field to heat a susceptor in thermal registry with a registered section of said disc to heat the registered section, said induction heater comprising two legs joined by a middle leg, and an excitation coil wrapped around said middle leg, wherein an alternating magnetic field is generated between opposing first ends of said two legs, said two legs arranged such that the susceptor is located therebetween.

23. The electrical lighter according to claim 10, further comprising a plurality of discs comprising said tobacco and at least one heater, wherein said means for registering registers a respective section of each of said plurality of discs with said at least one heater.

24. The electrical lighter according to claim 23, wherein said plurality of discs are arranged in a stack and a respective heater is respectively interposed between said stacked plurality of discs.

25. The electrical lighter according to claim 10, wherein said heater comprises an induction heater for generating an alternating magnetic field to heat a suspecter in thermal registry with a registered section of said disc to heat the registered section.

26. An electrical lighter for generating tobacco flavors, comprising:

a spiral structure comprising tobacco;

a heater;

means for registering a section of said spiral structure in thermal proximity to said heater, wherein a section of said spiral structure is heated to generate tobacco flavors and a successive section is registered with said heater; and means for drawing air across the heated section to deliver air and tobacco flavors to a smoker upon drawing.

27. The electrical lighter according to claim 26, wherein said spiral structure is a circular spiral.

28. The electrical lighter according to claim 26, wherein said spiral structure comprises a single turn.

29. The electrical lighter according to claim 26, wherein said spiral structure comprises multiple turns.

30. The electrical lighter according to claim 26, wherein said registering means comprises a drive axle and means for rotating said drive axle a desired amount to register a section of said spiral structure in thermal proximity to said heater; wherein said drive axle rotatably mates with a hub defined in said spiral structure; wherein said drive axle and said hub are configured such that as said drive axle rotates, said spiral structure rotates therewith and translates axially with respect thereto.

31. The electrical lighter according to claim 30, wherein said drive axle has an outer surface which mates with the hub of said structure and which comprises a number of adjacent equally sized faces, wherein a 360° turn of said hub comprises a corresponding number of adjacent angled inner faces which mate with the outer faces of said drive axle.

32. The electrical lighter according to claim 31, wherein said drive axle comprises four adjacent faces to define a rectangular cross section.

33. The electrical lighter according to claim 31, wherein the number of said drive axle outer faces define a drive axle cross section of a five pointed star.

34. The electrical lighter according to claim 30, further comprising a spiralled track affixed to a periphery of the hub, said spiralled track having indexing links defined therein.

35. The electrical lighter according to claim 34, wherein said drive axle further comprises a plurality of circularly arranged pins which mate with the indexing links, wherein said indexing links spiral around said circularly arranged pins, further comprising a support plate connected to said drive axle, said plurality of circularly arranged pins extending from said support plate.

36. The electrical lighter according to claim 34 wherein said spiral structure comprises multiple turns and the storage chamber and the disposal chamber are sized to store a desired number of turns in a compressed state, and wherein said registering means comprises means for separating two successive compressed turns from the storage chamber in the registry chamber to provide a gap therebetween for registry with said heater, and wherein said registering means further comprises means for compressing the separate successive turns after heating for disposing in the disposal chamber.

37. The electrical lighter according to claim 26, wherein said heater comprises a serpentine heating element electrically connected to a source of electrical energy.

38. The electrical lighter according to claim 26, wherein, after heating of a registered portion, said registering means registers a successive unheated portion of said spiral with said heater for subsequent heating.

39. The electrical lighter according to claim 38, wherein said spiral structure comprises multiple turns and the storage chamber and the disposal chamber are sized to store a desired number of turns in a compressed state.

40. The electrical lighter according to claim 39, wherein said registering means comprises means for separating two successive compressed turns from the storage chamber in the registry chamber to provide a gap therebetween for registry with said heater.

41. The electrical lighter according to claim 38 wherein said spiral structure comprises multiple turns and the storage chamber and the disposal chamber are sized to store a desired number of turns in a compressed state, wherein said registering means comprises means for separating two successive compressed turns from the storage chamber in the registry chamber to provide a gap therebetween for registry with said heater, and wherein said registering means further comprises means for compressing the separate successive turns after heating for disposal in the disposal chamber.

42. The electrical lighter according to claim 26 further comprising a housing structure enclosing the spiral structure, said housing comprising a supply chamber; a registry chamber adjoining said supply chamber; and a disposal chamber adjoining said registry chamber; wherein the section of said spiral structure registered with said heater is located within said registry chamber, unheated sections of said spiral structure are located within said supply chamber, and heated sections are located within said disposal chamber, said adjoining chambers separated by respective dividing walls having apertures for passage of sections of said spiral structure therethrough.

43. The electrical lighter according to claim 42, wherein said registering means comprises a drive axle rotatable a desired amount to register a section of said spiral structure in thermal proximity to said heater; wherein said drive axle rotatably mates with a hub defined in said spiral structure; wherein said drive axle and said hub are configured such that as said drive axle rotates, said spiral structure rotates therewith and translates axially with respect thereto, and wherein the apertures of said respective dividing walls of said housing are defined to permit said drive axle to extend therethrough and to rotate.

44. The electrical lighter according to claim 26, wherein said heater is a heater oriented parallel to a screw angle defined by said spiral structure.

45. An electrical smoking system comprising:

a disc shaped structure comprising tobacco;

a heater in thermal proximity to the tobacco; and a housing surrounding said disc shaped structure, said housing having apertures to permit air flow therethrough to carry evolved tobacco flavors to a smoker.

46. The electrical smoking system according to claim 45, wherein said housing comprises a window to permit registry between said disc and the heater.

47. The electrical smoking system according to claim 45, wherein the tobacco comprises reconsituted tobacco.

48. An electrical smoking system which is registered with a heater, the tobacco flavor supply comprising:

a heater, and a spiral shaped structure, said spiral shaped structure comprising tobacco.

49. The electrical smoking system according to claim 48, wherein said spiral shaped structure defines a hub, said hub shaped to mate with a drive axle such that as the drive axle rotates, said spiral shaped structure spirals along the drive axle.

50. The electrical smoking system according to claim 49, wherein said registering means comprises a drive axle rotatable a desired amount to register a section of said spiral structure in thermal proximity to said electrical heating means; wherein said drive axle rotatably mates with a hub defined in said spiral structure; wherein said drive axle and said hub are mated such that as said drive axle rotates, said spiral structure rotates therewith and translates axially with respect thereto, and wherein the apertures of said respective dividing walls of said housing extend and are sized to permit said drive axle to extend therethrough and to rotate.

51. The electrical smoking system according to claim 50, wherein said drive axle has an outer surface which mates with the hub of said structure and which comprises a number of adjacent equally sized faces, wherein a 360° turn of said hub comprises a corresponding number of adjacent angled interfaces which mate with the outer faces of said drive axle.

52. The electrical smoking system according to claim 50, further comprising a spiralled track affixed to a periphery of the hub, said spiralled track having indexing links defined therein:

wherein said drive axle further comprises a plurality of circularly arranged pins which mate with the indexing links, wherein said indexing links spiral around said circularly arranged pins.

53. The electrical smoking system according to claim 52, further comprising a support plate connected to said drive axle, said plurality of circularly arranged pins extending from said support plate.

54. The electrical smoking system according to claim 48 further comprising a housing structure enclosing the spiral structure, said housing comprising a supply chamber; a registry chamber adjoining said supply chamber; and a disposal chamber adjoining said registry chamber; wherein the section of said spiral structure registered with the electrical heating means is located within said registry chamber, said registry chamber provided with apertures to permit air flow therethrough to carry evolved tobacco flavors to a smoker, unheated sections of said spiral structure are located within said supply chamber, and heated sections are located within said disposal chamber, said adjoining chambers separated by respective dividing walls having apertures for passage of sections of said spiral structure therethrough.

55. The electrical smoking system according to claim 54, wherein said spiral structure comprises multiple turns and the storage chamber and the disposal chamber are sized to store a desired number of turns in a compressed state.

56. The electrical smoking system according to claim 54 wherein said spiral structure comprises multiple turns and the storage chamber and the disposal chamber are sized to store a desired number of turns in a compressed state, and wherein said registering means comprises means for separating two successive compressed turns from the storage chamber in the registry chamber to provide a gap therebetween for registry with said heater, and wherein said registering means further comprises means for compressing the separate successive turns after heating for disposal in the disposal chamber.

57. The electrical smoking system according to claim 48, wherein the tobacco comprises reconstituted tobacco.

58. The electrical smoking system according to claim 48, wherein said spiral structure is a circular spiral.

59. The electrical smoking system according to claim 48, wherein said spiral structure comprises multiple turns.

60. The electrical smoking system according to claim 48, further comprising a housing enclosing said spiral structure, said housing having apertures to permit airflow therethrough to carry evolved tobacco flavors to a smoker.

61. A method of generating tobacco flavors from tobacco, comprising the steps of:

providing a supply of tobacco;

rotating the supply of tobacco in an imaginary rotational path about an imaginary rotational axis;

heating a section of the supply of tobacco located in the imaginary rotational path to generate tobacco flavors; and directing air over the heated section to deliver air and the generated tobacco flavors to a smoker.

62. The method according to claim 61, wherein said heating step occurs when the supply is stationary.

63. The method according to claim 61, wherein said rotating step is repeated after said heating and directing steps to present a successive section of the tobacco supply for subsequent heating and directing steps.

64. The method according to claim 61, wherein said rotating step comprises rotating the tobacco supply in a rotational path which is planar.

65. The method according to claim 64, wherein said rotating step comprises rotating the tobacco supply in a planar rotational path which is angled relative to the imaginary rotational axis.

66. The method according to claim 61, wherein said rotating step comprises rotating the tobacco supply in a circular rotational path.

67. The method according to claim 61, further comprising separating unheated sections of the tobacco supply, the section of the tobacco supply being heated, and previously heated sections of the tobacco supply from one another.

68. The method according to claim 67, further comprising relatively compressing sections of the tobacco supply along the helical path, wherein the section of tobacco being heated is not relatively compressed.

* * * * *